US010957239B2

(12) United States Patent
Greenebaum et al.

(10) Patent No.: US 10,957,239 B2
(45) Date of Patent: Mar. 23, 2021

(54) GRAY TRACKING ACROSS DYNAMICALLY CHANGING DISPLAY CHARACTERISTICS

(71) Applicant: Apple Inc., Cupertino, CA (US)

(72) Inventors: Kenneth I. Greenebaum, San Carlos, CA (US); Gabriel Marcu, San Jose, CA (US); Arkady Ten, Sunnyvale, CA (US); Ian C. Hendry, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/146,627

(22) Filed: Sep. 28, 2018

(65) Prior Publication Data

US 2020/0105179 A1 Apr. 2, 2020

(51) Int. Cl.
*G09G 3/20* (2006.01)

(52) U.S. Cl.
CPC ..... *G09G 3/2074* (2013.01); *G09G 3/2051* (2013.01); *G09G 2320/029* (2013.01); *G09G 2360/16* (2013.01)

(58) Field of Classification Search
None
See application file for complete search history.

(56) References Cited

U.S. PATENT DOCUMENTS 7,777,760 B2 8/2010 Marcu
8,704,859 B2 4/2014 Greenebaum
8,773,451 B2 7/2014 Marcu
9,055,283 B2 6/2015 Chen
9,412,318 B2 8/2016 Chang
2008/0297451 A1* 12/2008 Marcu ..... G09G 3/20 345/77
2012/0056911 A1* 3/2012 Safaee-Rad ..... G09G 3/2003 345/690
2014/0092147 A1* 4/2014 Kimura ..... G09G 3/3426 345/690
2014/0267785 A1* 9/2014 Chen ..... H04N 17/02 348/189
2015/0348502 A1* 12/2015 Marcu ..... G06K 9/4652 345/594
2017/0092229 A1 3/2017 Greenebaum
2017/0110092 A1 4/2017 Li
2018/0089861 A1* 3/2018 Klement ..... G06T 11/001

* cited by examiner

*Primary Examiner* — YuJang Tswei
(74) *Attorney, Agent, or Firm* — Blank Rome LLP

(57) ABSTRACT

An output device is set to a first state in which a value of a first characteristic of the output device is set to a first value. Pixel adjustment values for plural gray levels are set to first pixel adjustment values in response to the output device being set to the first state. The value of the first characteristic is changed from the first value to a second value to set the output device to a second state. The pixel adjustment values for the plural gray levels are updated to second pixel adjustment values in response to the output device being set to the second state. The second pixel adjustment values are derived based on the second value of the first characteristic. Pixel values applied to a plurality of pixels of the output device are corrected based on the second pixel adjustment values.

20 Claims, 11 Drawing Sheets

GRAY TRACKING ACROSS DYNAMICALLY CHANGING DISPLAY CHARACTERISTICS

BACKGROUND

This disclosure relates generally to dynamically correcting gray tracking for output devices. More particularly, but not by way of limitation, this disclosure relates to updating the correction applied to each color channel for a display device based on dynamically changing display characteristics such as white point, black point, and the like.

Modern consumer electronic devices incorporate display devices (e.g., liquid crystal display (LCD), organic light emitting diode (OLED), plasma, digital light processing (DLP), and the like) to exchange information with users and to impart visual impression. Operation characteristics of the display devices may vary from device to device, even in the same product line or manufacturing line, due to inherent properties of the display devices. For example, variations may exist in LCD components, such as backlight variations due to light emitting diode (LED) wavelength and phosphor concentration, color filter thickness, and the like. Thus, each display device may have slightly different color characteristics, white points, and the like.

Further, modern consumer electronic devices (especially, mobile devices) are increasingly being used in a multitude of different environments with different and changing lighting and/or ambient conditions (e.g., home, office, home theater, outdoors, and the like). In order to keep a viewer's perception of the displayed data relatively stable despite changes in the ambient conditions in which the display device is being viewed, image processing techniques may be employed to modify display characteristics (e.g., white point, black point, gamma, and the like) of the display device to cause the display device to adapt to the user. For example, the white point may be moved to a perceptually warmer, less blue light in a night-time environment to give a more soothing experience to the user. As another example, a color ambient light sensor may be employed to understand illumination in an environment and move the display characteristics (e.g., white point, black point, gamma, and the like) to integrate the display device into the perceptual space of the user, leading to poor gray tracking. When pixel adjustment values generated during gray tracking calibration based on a target white point are applied to pixel data after the white point is moved to a different point, the output gray levels tend to have a wandering hue that varies for gray intensity levels from black to the current set white point. That is, although the hue for different gray levels is expected to move when the white point is moved, the hue is expected to move in the same manner and consistently across all gray levels, not in a different manner for different gray levels.

SUMMARY

The following presents a simplified summary of the disclosed subject matter in order to provide a basic understanding of some aspects of the subject matter disclosed herein. This summary is not an exhaustive overview of the technology disclosed herein. It is not intended to identify key or critical elements of the invention or to delineate the scope of the invention. Its sole purpose is to present some concepts in a simplified form as a prelude to the more detailed description that is discussed later.

In one embodiment a method includes: setting an output device to a first state in which a value of a first characteristic of the output device is set to a first value; setting pixel adjustment values for a plurality of gray levels to first pixel adjustment values in response to the output device being set to the first state, wherein the first pixel adjustment values are based on actual measured values for the plurality of gray levels measured when the first characteristic of the output device is set to the first value; changing the value of the first characteristic of the output device from the first value to a second value to set the output device to a second state; updating the pixel adjustment values for the plurality of gray levels to second pixel adjustment values in response to the output device being set to the second state, wherein the second pixel adjustment values are dynamically derived based on the second value of the first characteristic of the output device and based on the first pixel adjustment values; and correcting pixel values applied to a plurality of pixels of the output device based on the second pixel adjustment values.

In another embodiment, the method may be embodied in computer executable program code and stored in a non-transitory storage device. In yet another embodiment, the method may be implemented on an electronic device.

BRIEF DESCRIPTION OF THE DRAWINGS

While certain embodiments will be described in connection with the illustrative embodiments shown herein, the invention is not limited to those embodiments. On the contrary, all alternatives, modifications, and equivalents are included within the spirit and scope of the invention as defined by the claims. In the drawings, which are not to scale, the same reference numerals are used throughout the description and in the drawing figures for components and elements having the same structure, and primed reference numerals are used for components and elements having a similar function and construction to those components and elements having the same unprimed reference numerals.

DESCRIPTION

Figure 1:
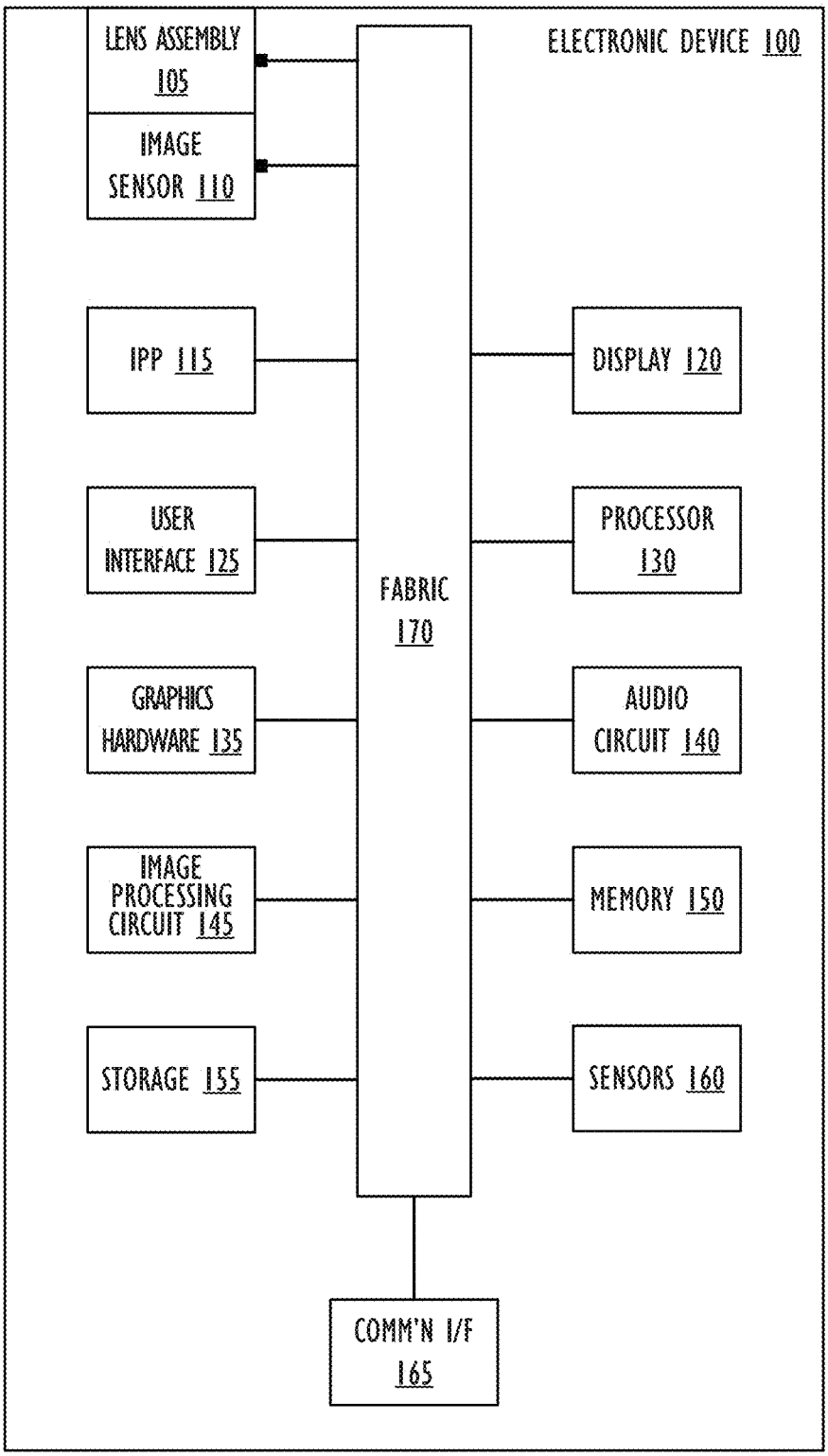
FIG. 1 shows, in block diagram form, a simplified functional block diagram of an illustrative electronic device, in accordance with one or more embodiments.

In the following description, for purposes of explanation, numerous specific details are set forth in order to provide a thorough understanding of the inventive concept. As part of this description, some of this disclosure's drawings represent structures and devices in block diagram form in order to avoid obscuring the invention. In the interest of clarity, not all features of an actual implementation are described. Moreover, the language used in this disclosure has been principally selected for readability and instructional purposes, and may not have been selected to delineate or circumscribe the inventive subject matter, resort to the claims being necessary to determine such inventive subject matter. Reference in this disclosure to "one embodiment" or to "an embodiment" means that a particular feature, structure, or characteristic described in connection with the embodiment is included in at least one embodiment of the invention, and multiple references to "one embodiment" or "an embodiment" should not be understood as necessarily all referring to the same embodiment.

It will be appreciated that in the development of any actual implementation (as in any development project), numerous decisions must be made to achieve the developers' specific goals (e.g., compliance with system- and business-related constraints), and that these goals may vary from one implementation to another. It will also be appreciated that such development efforts might be complex and time-consuming, ut would nevertheless be a routine undertaking for those of ordinary skill in the design and implementation of signal processing having the benefit of this disclosure.

The terms "a," "an," and "the" are not intended to refer to a singular entity unless explicitly so defined, but include the general class of which a specific example may be used for illustration. The use of the terms "a" or "an" may therefore mean any number that is at least one, including "one," "one or more," "at least one," and "one or more than one." The term "or" means any of the alternatives and any combination of the alternatives, including all of the alternatives, unless the alternatives are explicitly indicated as mutually exclusive. The phrase "at least one of" when combined with a list of items, means a single item from the list or any combination of items in the list. The phrase does not require all of the listed items unless explicitly so defined.

This disclosure pertains to updating (changing or correcting) gray tracking (e.g., gray gradient, or gray vector) in response to dynamically changing display characteristics (e.g., white point, black point, gamma, temperature, and the like) of an output device (display device) so as to appear of consistent, neutral hue. In a factory during manufacture, one or more gray tracking calibrations may be performed with a display characteristic of the display device set to have respective different values (e.g., multiple calibrations for multiple different set white points). A dynamic gray tracking engine may determine pixel adjustment values (correction tables or in the form of a parametric solution) based on actual measured colorimetric response display values for each gray tracking calibration. In one embodiment, a sampling of characteristic values for which the actual measured calibration is to be performed may be determined based on a 1D, 2D, or 3D range of possible display input values/codes the display characteristic may hold for which a correction table may have to be derived or synthesized.

During operation, when the display device is set to a target value for a display characteristic (e.g., target white point) for which actual measured gray tracking calibration data is available (e.g., adjustment values for each color channel in a correction table or LUT), the gray tracking engine may correct pixel values based on adjustment values (e.g., correction table or parametric solution) associated with the target value. Subsequently, when the target value dynamically changes to a different value (e.g., white point being constantly changed, or display panel temperature change), the gray tracking engine may update the gray vector for each color channel to correspond to the different value based on the calibration and measurement data of multiple gray tracking calibrations (LUTs or a parametric solution derived from a model generated based on the calibration data or from an analysis of the calibration data). In one embodiment, bi-linear, tri-linear, multi-linear, or tetrahedral interpolation techniques may be employed to derive a correction table of pixel adjustment values (e.g., 1D LUT for each color channel, 3D LUT, matrix, function, and the like) corresponding to the different value (e.g., moved white point) based on respective stored correction tables corresponding to the nearest two or more values for which the gray tracking calibration based on actually measured values has been performed.

In another embodiment, a mathematical model may be developed that can represent the effect of several primary, secondary, or tertiary factors (e.g., sub-pixel crosstalk, quarter wavelength shutter effects, thermal issues, and the like) that cause the gray tracking to 'break' (e.g., gray tracking gets de-tuned) when the display characteristic value is moved (e.g., white point is changed). The math model may include a polynomial equation developed based on actual measurements across characteristic values and component brightness levels (e.g., calibration data of different white points), and the mathematical model may be trained to represent the effect of factors influence on gray tracking for a given display to be calibrated by solving for coefficients in the polynomial equation. Then, as the value of the display characteristic dynamically changes, the model, which may be very compact as compared to the multiple correction tables based on multiple gray tracking calibrations, may synthesize a gray tracking correction table for the dynamically moved characteristic value (e.g., moved white point) of the particular display device. The model may also synthesize the correction table based on one or more alternative or additional parameters (e.g., temperature, black point, gamma, and the like). Further, instead of synthesizing the correction table, the model may directly be applied as a parametric solution (e.g., shader or bespoke hardware) to correct the pixel values of pixels of the output device based on the changed display characteristic value. The mathematical model may also be an analytical model, artificial intelligence model, or other type of model developed by analyzing the respective stored correction tables generated during the multiple gray tracking calibrations in which actual measured colorimetric response display values are measured.

To avoid colors from 'flashing' (e.g., colors 'popping' due to sudden change in hue across gray levels), the (interpolated or synthesized) changes to correct the gray tracking vector (represented by correction table or equation) may be animated by an animation engine to smooth the transition from a current gray tracking correction table (or parametric solution) to a desired gray tracking correction table (or parametric solution) that corresponds to the current display characteristic value (e.g., moved white point). For example, the current and desired tables may be linearly interpolated to successively step between intermediate tables over a short period of time to gradually transition from the current gray gradient or vector to the desired gray vector, instead of instantly snapping to the new gray vector such that the step between any two successive correction steps doesn't cause displayed color to change by more than a perceived just noticeable difference (JND) perceivable by the viewer.

The native white point of a display device may be defined by a pair of chromaticity values (x, y) that represent the color produced by the device when the device generates all colors at full power. For example, when red, green, and blue channels for a display device are all active at full power (e.g., maximum voltage applied from display driver to each of the red, green, and blue sub-pixels of the display), the chromaticity values, as measured in Cartesian coordinates x and y with respect to a chromaticity diagram, are the native white point of the display device. White points may vary among display devices of the same type due to inherent properties such that when the red, green, and blue channels for a display device are all active at full power, the resulting (x, y) chromaticity value corresponding to the white point is different from the (x, y) chromaticity value corresponding to the white point of another display device when the red, green, and blue channels for the other display device are also all active at full power.

This native or original (uncorrected) white point of each display device may be corrected in a white point calibration process to be adjusted to a target white point which is consistent across multiple display devices that are of the same type (and therefore, are expected to have the same white point). For example, the target white point may correspond to the D65 illuminant of the CIE. In the white point calibration, each device may be tuned (e.g., in a factory) to the same target white point by adjusting display control settings such as gain values for the red, green, and blue channels individually. After the white point calibration, the deviation among the multiple devices may be reduced such that the (target) white point of the devices would be within a given range of target chromaticity coordinates ($x_0$, $y_0$)).

In addition to white point calibration, the display devices may be also subject to gray tracking calibration to faithfully reproduce the full range of gray levels from black to white (represented by the target white point) on the display device so that the shades of gray (e.g., linear range of R=G=B from 0 to 1) at different luminance levels will all appear to have the same hue as the target white point (e.g., target chromaticity coordinates ($x_0$, $y_0$)) of the target white point.

However, several complexities inherent to the display devices (e.g., LCD-based display devices) limit utility of the gray tracking calibration (and corresponding generated pixel adjustment values) to a particular target white point of the display device that was used during actual measurements of colorimetric response display values based on which the corresponding pixel adjustment values were generated and stored in a correction table during the gray tracking calibration. That is, the gray tracking calibration begins to 'break' (e.g., gray tracking calibration gets de-tuned) when the target white point of the display device is moved from the white point where the gray tracking calibration was performed to a different white point (e.g., moved to chromaticity coordinates ($x_1$, $y_1$) from ($x_0$, $y_0$)).

Referring to FIG. 1, a simplified functional block diagram of illustrative electronic device 100 capable of rendering text and other information onto an image or video sequence is shown according to one or more embodiments. Electronic device 100 could be, for example, a mobile telephone, personal media device, a notebook computer system, a tablet computer system, or a desktop computer system. As shown, electronic device 100 may include lens assembly 105 and image sensor 110 for capturing images of a scene such as an HDR video. In addition, electronic device 100 may include image processing pipeline (IPP) 115, display element 120, user interface 125, processor(s) 130, graphics hardware 135, audio circuit 140, image processing circuit 145, memory 150, storage 155, sensors 160, communication interface 165, and communication network or fabric 170.

Lens assembly 105 may include a single lens or multiple lens, filters, and a physical housing unit (e.g., a barrel). One function of lens assembly 105 is to focus light from a scene onto image sensor 110. Image sensor 110 may, for example, be a CCD (charge-coupled device) or CMOS (complementary metal-oxide semiconductor) imager. Device 100 may include more than one lens assembly and more than one image sensor. Each lens assembly may focus light onto a single image sensor (at the same or different times) or different portions of a single image sensor.

IPP 115 may process image sensor output (e.g., RAW image data from sensor 110) to yield a HDR image, image sequence or video sequence. More specifically, IPP 115 may perform a number of different tasks including, but not be limited to, black level removal, de-noising, lens shading correction, white balance adjustment, demosaicing operations, and the application of local or global tone curves or maps. IPP 115 may also perform gray tracking across dynamically changing white point according to one or more embodiments. IPP 115 may comprise a custom designed integrated circuit, a programmable gate-array, a central processing unit (CPU), a graphical processing unit (GPU), memory or a combination of these elements (including more than one of any given element; non-transitory program storage device; programmable control device). Some functions provided by IPP 115 may be implemented at least in part via software (including firmware).

Display element (display device, display panel, or display) 120 may be a wide gamut display and may be used to display text and graphic output as well as receiving user input via user interface 125. For example, display element 120 may be a touch-sensitive display screen. User interface 125 can also take a variety of other forms such as a button, keypad, dial, a click wheel, and keyboard.

Processor 130 may be a system-on-chip (SOC) such as those found in mobile devices and include one or more dedicated CPUs and one or more GPUs. Processor 130 may be based on reduced instruction-set computer (RISC) or complex instruction-set computer (CISC) architectures or any other suitable architecture and each computing unit may include one or more processing cores. Graphics hardware 135 may be special purpose computational hardware for processing graphics and/or assisting processor 130 perform computational tasks. In one embodiment, graphics hardware 135 may include one or more programmable GPUs each of which may have one or more cores. Audio circuit 140 may include one or more microphones, one or more speakers and one or more audio codecs. Image processing circuit 145 may aid in the capture of still and video images from image sensor 110 and include at least one video codec. Image processing circuit 145 may work in concert with IPP 115, processor 130 and/or graphics hardware 135.

Images, once captured, may be stored in memory 150 and/or storage 155. Memory 150 may include one or more different types of media used by IPP 115, processor 130, graphics hardware 135, audio circuit 140, and image processing circuitry 145 to perform device functions. For example, memory 150 may include memory cache, read-only memory (ROM), and/or random access memory (RAM). Storage 155 may store media (e.g., audio, image and video files), computer program instructions or software, preference information, device profile information, and any other suitable data. Storage 155 may include one more non-transitory storage mediums including, for example, magnetic disks (fixed, floppy, and removable) and tape, optical media such as CD-ROMs and digital video disks (DVDs), and semiconductor memory devices such as Electrically Programmable Read-Only Memory (EPROM), and Electrically Erasable Programmable Read-Only Memory (EEPROM).

Device sensors 160 may include, but need not be limited to, an optical activity sensor, an optical sensor array, an accelerometer, a sound sensor, a barometric sensor, a proximity sensor, an ambient light sensor, a vibration sensor, a gyroscopic sensor, a compass, a barometer, a magnetometer, a thermistor sensor, an electrostatic sensor, a temperature sensor, a heat sensor, a thermometer, a light sensor, a differential light sensor, an opacity sensor, a scattering light sensor, a diffractional sensor, a refraction sensor, a reflection sensor, a polarization sensor, a phase sensor, a florescence sensor, a phosphorescence sensor, a pixel array, a micro pixel array, a rotation sensor, a velocity sensor, an inclinometer, a pyranometer and a momentum sensor.

Communication interface 165 may be used to connect device 100 to one or more networks. Illustrative networks include, but are not limited to, a local network such as a universal serial bus (USB) network, an organization's local area network, and a wide area network such as the Internet. Communication interface 165 may use any suitable technology (e.g., wired or wireless) and protocol (e.g., Transmission Control Protocol (TCP), Internet Protocol (IP), User Datagram Protocol (UDP), Internet Control Message Protocol (ICMP), Hypertext Transfer Protocol (HTTP), Post Office Protocol (POP), File Transfer Protocol (FTP), and Internet Message Access Protocol (IMAP)). Communication network or fabric 170 may be comprised of one or more continuous (as shown) or discontinuous communication links and be formed as a bus network, a communication network, or a fabric comprised of one or more switching devices (e.g., a cross-bar switch). In general, one or more of processor 130, graphics hardware 135 and image processing circuit 135 may be configured to render selected information (textual or graphic) in a designated or specified region within an image or frame.

Figure 2:
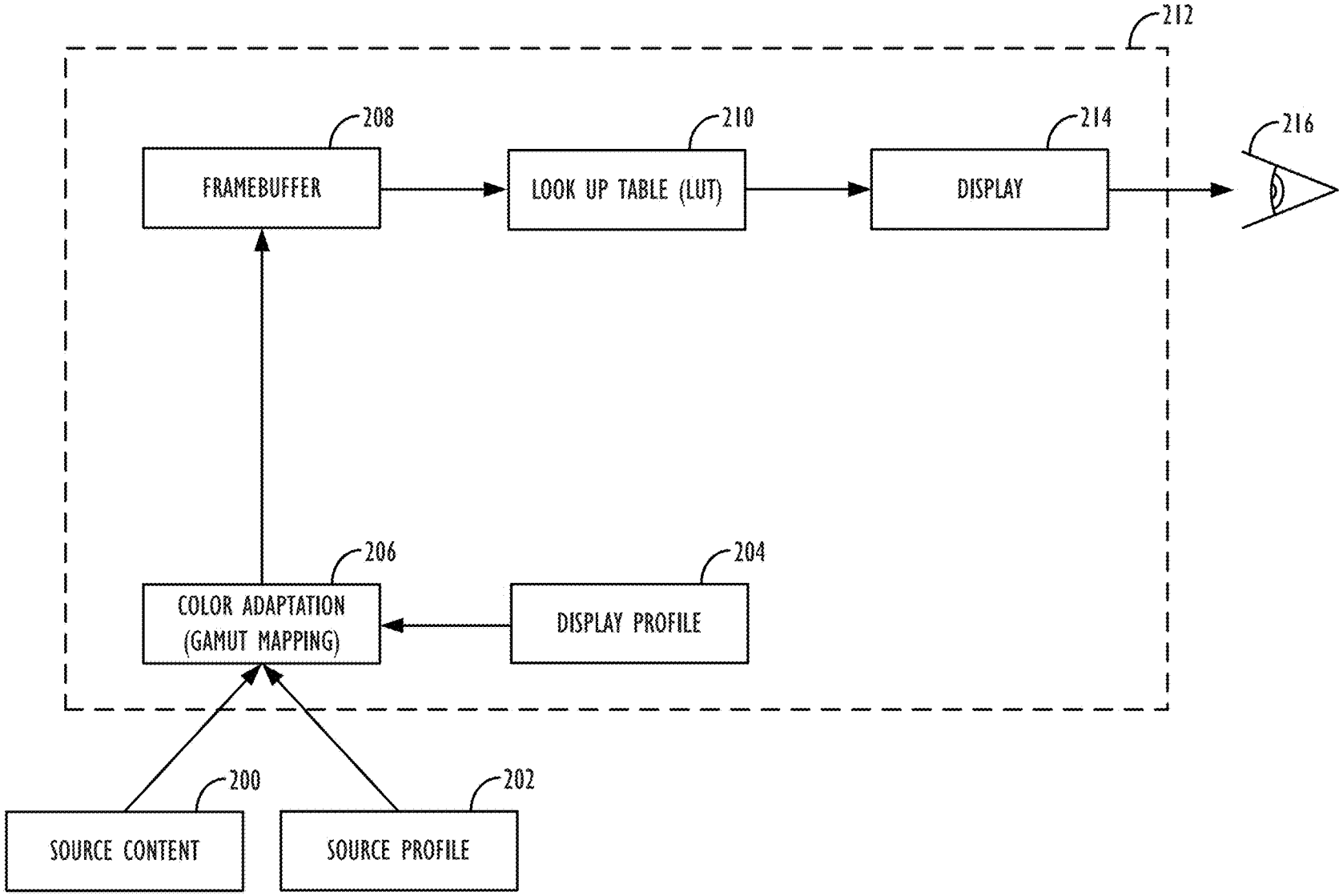
FIG. 2 illustrates a system for performing gamma adjustment utilizing a look up table (LUT), in accordance with one or more embodiments.

Referring now to FIG. 2, a typical system 212 for performing gamma adjustment utilizing a single LUT for all 3 channels, or multiple LUTs, one per channel (LUT 210 is shown). Element 200 represents source content, created by a source content author, that viewer 216 wishes to view. Source content 200 may comprise an image, video, or other displayable content type. Element 202 represents a source profile (e.g., an ICC profile of the author's device or color space, or other related information), that is, information describing the color profile and display characteristics of the device on which source content 200 was authored by the source content author.

Information relating to the source content 200 and source profile 202 may be sent to viewer 216's device containing the system 212 for performing gamma adjustment utilizing a LUT 210. Viewer 216's device may comprise, for example, a mobile phone, PDA, HMD, monitor, television, projector, or a laptop, desktop, or tablet computer. Upon receiving the source content 200 and source profile 202, system 212 may perform a color adaptation process 206 on the received data for performing gamut mapping, or color matching across various color spaces. For instance, gamut matching tries to preserve (as closely as possible) the relative relationships between colors, even if all the colors must be systematically distorted in order to get them to display on the destination device.

Once the source image had the source to destination gamut adaptation applied, image values may enter the so-called "framebuffer" 208. In some embodiments, image values entering framebuffer 208 having come from an application or applications that have already processed the image values to be encoded with a specific implicit gamma. A framebuffer may be defined as a video output device that drives a video display from a memory buffer containing a complete frame of, in this case, image data. The implicit gamma of the values entering the framebuffer can be visualized by looking at the "Framebuffer Gamma Function," as will be explained further below in relation to FIG. 3. Ideally, this Framebuffer Gamma Function is the exact inverse of the display device's "Native Display Response" function relative to the target gamma function, which characterizes the luminance response of the display to input.

Because the Native Display Response isn't always exactly the inverse of the Framebuffer Gamma Function, a LUT, sometimes stored on a video card or in other memory, may be used to account for the imperfections in the relationship between the encoding gamma and decoding gamma values, as well as the display's particular luminance response characteristics. Thus, if necessary, system 212 may then utilize LUT 210 to perform a so-called "gamma adjustment process." LUT 210 may comprise a two-column table of positive, real values spanning a particular range (e.g., from zero to one). The first column values may correspond to an input image value, whereas the second column value in the corresponding row of the LUT 210 may correspond to an output image value that the input image value will be "transformed" into before being ultimately displayed on display 214. LUT 210 may be used to account for the imperfections in the display 214's luminance response curve, also known as a transfer function. In other embodiments, a LUT may have separate channels for each primary color in a color space (e.g., a LUT may have Red, Green, and Blue channels in the sRGB color space). Alternately, LUT 210 may be a 3D LUT that includes a coordinate set of colors to directly transform an input coordinate set of colors to an output coordinate set.

The transformation applied by LUT 210 to the incoming framebuffer data before the data is output to the display device may be used to ensure that a desired 1.0 gamma boost is applied to the content that is being displayed on display device 214. An overall 1.0 gamma boost corresponds to a linear relationship between the digital values and the output luminance on the display device 214. Ideally, an overall 1.0 gamma boost will correspond to the source author's intended look of the displayed content.

Figure 3:
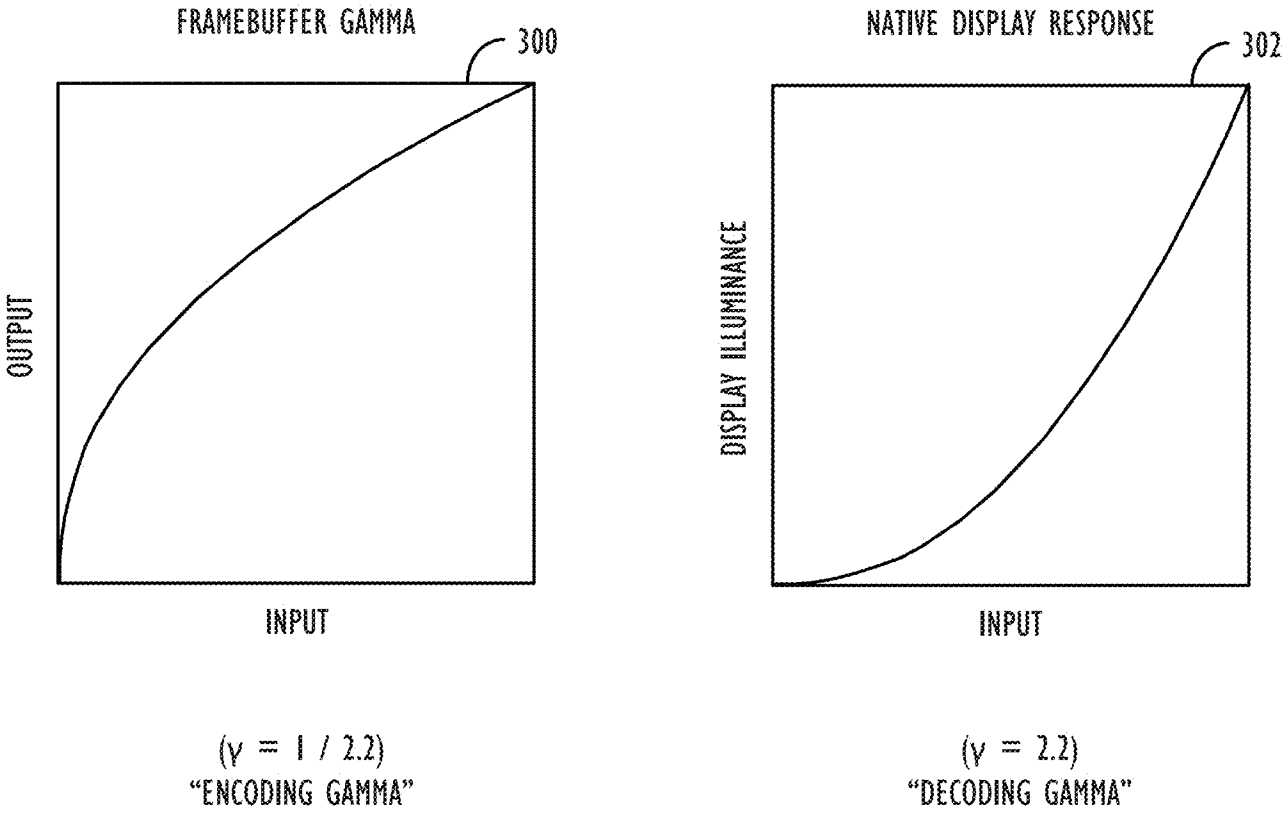
FIG. 3 illustrates a Framebuffer Gamma Function and an exemplary Native Display Response, in accordance with one or more embodiments.

Referring now to FIG. 3, a Framebuffer Gamma Function 300 and an exemplary Native Display Response function 302 is shown. Gamma adjustment, or, as it is often simply referred to, "gamma," is the name given to the nonlinear operation commonly used to encode luminance into digital values and decode digital values into luminance values in video or still image systems. Gamma, $\gamma$, may be defined by the following simple power-law expression: $L_{out}=L_{in}^{\gamma}$, where the input and output values, $L_{in}$ and $L_{out}$, respectively, are non-negative real values, typically in a predetermined range (e.g., zero to one). A gamma value greater than one is sometimes called an "encoding gamma," and the process of encoding with this compressive power-law nonlinearity is called "gamma compression;" conversely, a gamma value less than one is sometimes called a "decoding gamma," and the application of the expansive power-law nonlinearity is called "gamma expansion." Gamma encoding of content helps to map the content data into a more perceptually-uniform domain.

Stated another way, the gamma characteristic of a system is an approximate relationship between the encoded digital values in the system and the actual desired image luminance on whatever the eventual user display device is. In existing systems, a computer processor or other suitable programmable control device may perform gamma adjustment computations for a particular display device it is in communication with based on the native luminance response of the display device, the color gamut of the device, and the device's white point (which may be stored in an ICC profile), as well as the ICC color profile the source content's author attached to the content to specify the content's "rendering intent."

The ICC profile is a set of data that characterizes a color input or output device, or a color space, according to standards promulgated by the International Color Consortium (ICC). ICC profiles may describe the color attributes of a particular device or viewing requirement by defining a mapping between the device source or target color space and a profile connection space (PCS). Matrix/Tone Response Curve (TRC) type of ICC profiles may be used to define a color space mapping generically in terms of three main pieces: 1) the color primaries that define the gamut; 2) the transfer function (sometimes referred to as the gamma function); and 3) the white point. ICC profiles may also contain additional information (e.g., its TRC) to provide mapping between a display's actual response and its "advertised" response. An overall 1.0 gamma boost corresponds to a linear relationship between the input encoded digital values and the output luminance on the display device, meaning there is actually no amount of gamma "boosting" being applied.

Returning now to FIG. 3, the x-axis of Framebuffer Gamma Function 300 represents input image values spanning a particular range (e.g., from zero to one). The y-axis of Framebuffer Gamma Function 300 represents output image values spanning a particular range (e.g., from zero to one). As mentioned above, in some embodiments, image values may enter the framebuffer 208 already having been processed and have a specific implicit gamma. As shown in graph 300 in FIG. 3, the encoding gamma is roughly 1/2.2, or 0.45. That is, the line in graph 300 roughly looks like the function, $L_{OUT}=L_{IN}^{45}$. Gamma values around 1/2.2, or 0.45, are typically used as encoding gammas because the native display response of many display devices have a gamma of roughly 2.2, that is, the inverse of an encoding gamma of 1/2.2.

The x-axis of Native Display Response function 302 represents input image values spanning a particular range (e.g., from zero to one). The y-axis of Native Display Response Function 302 represents output image values spanning a particular range (e.g., from zero to one). In theory, systems in which the decoding gamma is the inverse of the encoding gamma should produce the desired overall 1.0 gamma boost.

Figure 4:
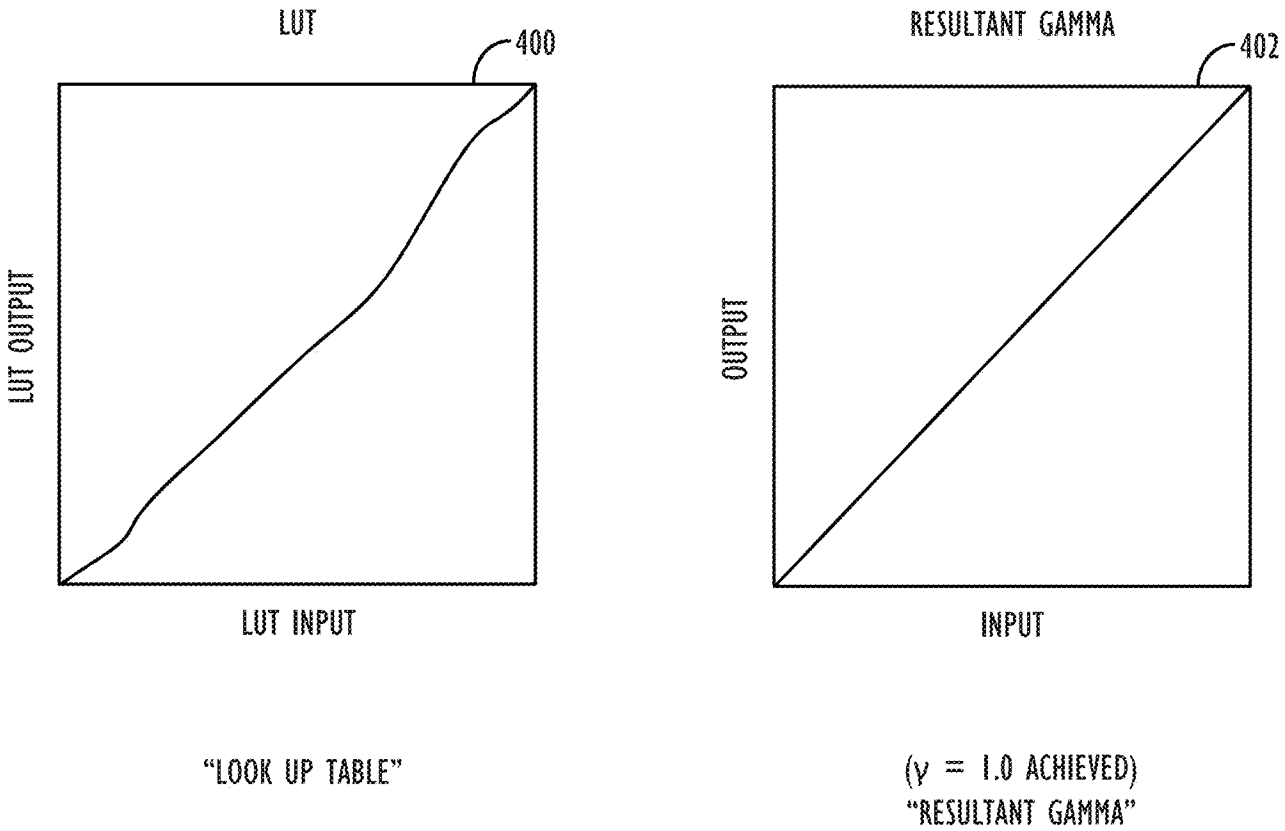
FIG. 4 illustrates a graph representative of a LUT transformation and a Resultant Gamma Function, in accordance with one or more embodiments.

Referring now to FIG. 4, a graph representative of a LUT transformation 400 and a Resultant Gamma Function 402 are shown. The graphs in FIG. 4 show how, in an ideal system, a LUT may be utilized to account for the imperfections in the relationship between the encoding gamma and decoding gamma values, as well as the display's particular luminance response characteristics at different input levels. The LUT (e.g., LUT 210) may be a result of gamma calibration in which chromaticity coordinates and brightness of the display device may be measured while adjusting gray levels for each color channel (e.g., red, green, and blue channels) up to a maximum level. The measured values may indicate a native or uncalibrated gamma, and uncalibrated curves of brightness versus gray levels for each color channel based on which LUT graph 400 may be determined to meet a target gamma for all color channels. The x-axis of LUT graph 400 represents input image values spanning a particular range (e.g., from zero to one). The y-axis of LUT graph 400 represents output image values spanning a particular range (e.g., from zero to one). Resultant Gamma Function 402 reflects a desired overall 1.0 gamma boost resulting from the gamma adjustment provided by the LUT. The x-axis of Resultant Gamma Function 402 represents input image values as authored by the source content author spanning a particular range (e.g., from zero to one). The y-axis of Resultant Gamma Function 402 represents output image values displayed on the resultant display spanning a particular range (e.g., from zero to one). The slope of 1.0, reflected in the line in graph 402, indicates that luminance levels intended by the source content author will be reproduced at corresponding luminance levels on the ultimate display device.

In addition to accounting for gamma calibration, LUT graph 400 may also be generated so as to account for the gray tracking calibration to faithfully reproduce the full range of gray levels from black to white on the display device so that the shades of gray (e.g., linear range of R=G=B from 0 to 1) at different luminance levels will all appear to have the same neutral hue for a given white point. Gray tracking calibration evaluates and corrects for non-linearities in each color channel for each gray step for both hue and brightness. Gray tracking calibration further evaluates and corrects for other issues like sub-pixel crosstalk, quarter wavelength shutter effects, thermal issues, and the like. For example, the red, green, and blue channels may be calibrated for the display device to produce true gray levels with the same neutral hue and corresponding brightness for all gray intensity levels from black to the target white point by actually measuring from the display device, at suitable points of gray intensity levels output to the display device, colorimetric response display values of uncorrected digital values. The measured colorimetric response values (actual pixel response) may then be analyzed to determine how they deviate from 'ideal' values and to generate adjustment values that produce the true ('ideal') gray levels with the display device for the associated white point. All values of interest may then be accurately interpolated for the associated white point based on the actual measurements at the suitable points of gray intensity levels to generate the adjustment values for all gray levels for hue and brightness for the associated white point. The gray tracking calibration can, for example, be based on one or more techniques described in U.S. Pat. No. 7,777,760 by Marcu, et al., which issued Aug. 17, 2010, and is hereby incorporated by reference in its entirety.

The pixel (e.g., digital values for RGB) adjustment values for gray tracking may be stored in the same LUT as LUT 210 for gamma correction or may be stored in a different LUT for gray tracking correction. LUT 210 may include, for example, a LUT for red values between 0 and 255, a LUT for green values between 0 and 255, and a LUT for blue values between 0 and 255. The LUTs for red, green, and blue values may be independent of each other and provide respective adjustment values for red, green, and blue independently for each of red, green, and blue color. Alternately, LUT 210 may be a 3D LUT in which respective adjustment values for red, green, and blue are interdependent.

Figure 5:
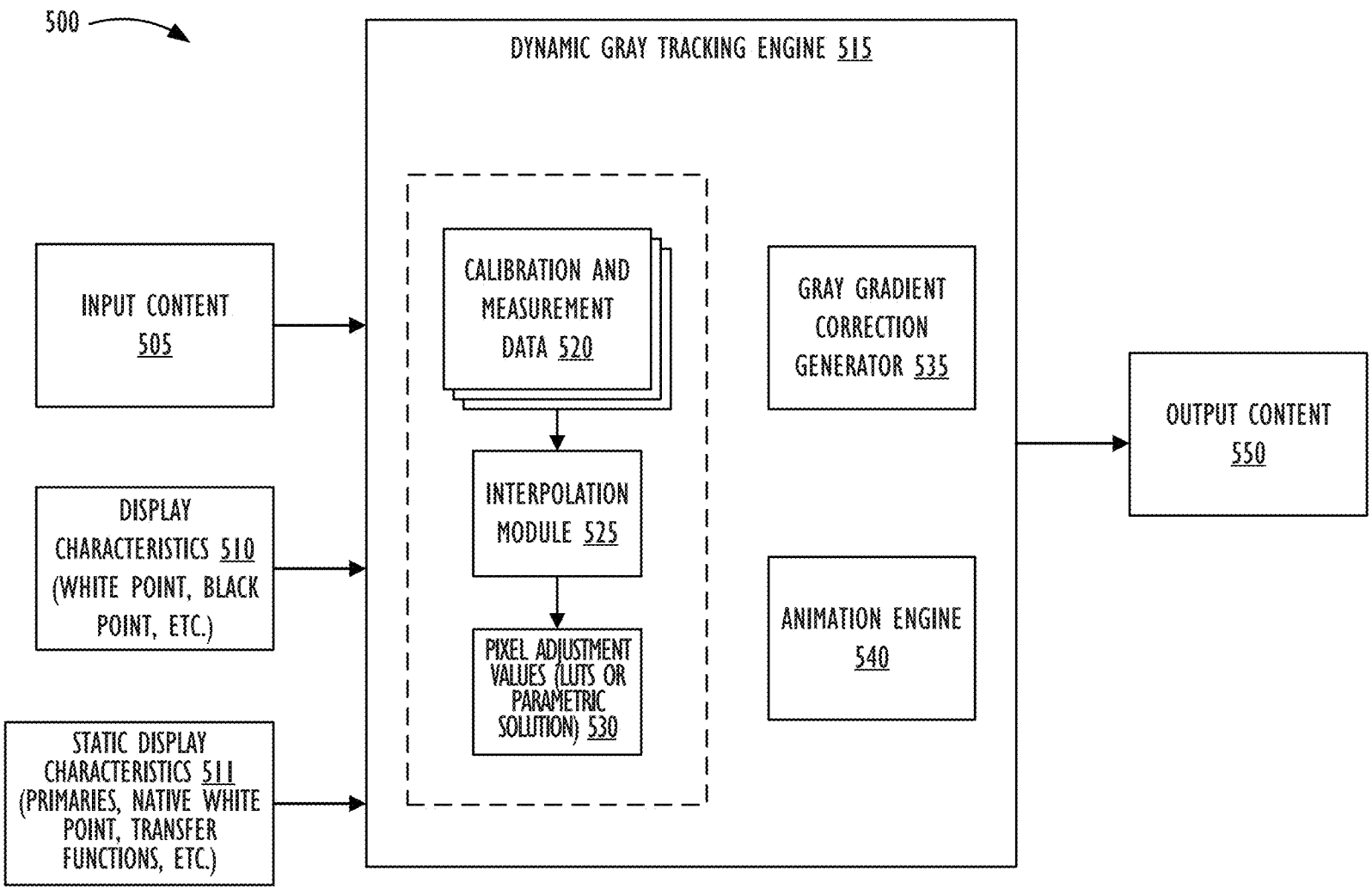
FIG. 5 illustrates system for performing dynamic gray tracking, in accordance with one or more embodiments.

FIG. 5 illustrates system 500 for performing dynamic gray tracking, in accordance with one or more embodiments. Dynamic gray tracking engine 515 may be implemented using any suitable combination of chipset, firmware, and/or software that may be associated with a display pipeline for image display. In one embodiment, dynamic gray tracking engine 515 may be implemented in IPP 115 shown in FIG. 1. For example, dynamic gray tracking engine 515 may be implemented as a daemon running in background on electronic device 100 that subscribes to sensor data from sensors 160, so that dynamic gray tracking engine 515 may be triggered to change the gray tracking when predetermined display characteristics (e.g., white point, black point, and other parameters) are changed, based on (or as determined by) the sensor data (e.g., ambient conditions, perceptual adaption conditions, user operation, and the like).

Alternately, dynamic gray tracking engine 515 may be implemented in chipset, firmware, and/or software residing in the display device (e.g., display 120, 214, 1010 in FIG. 10, and the like) itself. For example, dynamic gray tracking engine 515 may be implemented, at least in part, using a timing controller (TCON) chip or another hardware chip in the display device, and/or using metadata for the display device that describes device capabilities to a video source (e.g., Extended Display Identification Data (EDID)). In one embodiment, the daemon running in background on electronic device 100 may control to dynamically move or change the display characteristics (e.g., white point, black point, and other parameters) based on the sensor data by providing appropriate update parameters to display 120 (or 214, 1010 in FIG. 10). The display may then update the display characteristics, and dynamic gray tracking engine 515 implemented on display 120 (or 214, 1010 in FIG. 10) may then update gray tracking based on the received update parameters.

Calibration and measurement data 520 may represent correction tables or a plurality of LUTs (e.g., LUTs 210) generated during calibration of the display device (including, at least, the gray tracking calibration). As alluded to earlier, since modern consumer electronic devices (especially, mobile devices; e.g., electronic device 100 in FIG. 1) are increasingly being used in a multitude of different environments, display characteristics (e.g., white point, black point, gamma, temperature (thermal component) and the like) of the display device may be constantly and dynamically changing to, for example, cause the display device to operate seamlessly in different environment conditions so as to keep the viewer's perception of the displayed data relatively stable regardless of the environment in which the device is being viewed. For example, sensor data from sensors 160 (or data based on a user setting/operation) may be input to a daemon (e.g., IPP 115 of FIG. 1) continuously running in background on electronic device 100 to dynamically change one or more display characteristics (e.g., white point, black point, gamma, temperature and the like) of the display device (e.g., display 120, 214, 1010, and the like). And since the pixel adjustment values (or parametric solution) currently set for the gray tracking are no longer accurate once the display state of the display device is changed (e.g., dynamically moving one or more of white point, black point, gamma, and the like), it is necessary to update the gray tracking in response to the changed display state. In order to accurately update the gray tracking to correspond to the current display state of the display, calibration data of multiple gray tracking calibrations based on actually measured values in multiple different display states (e.g., different white points) of the display is generated and utilized as calibration and measurement data 520 by dynamic gray tracking engine 515.

For example, in a factory during manufacture (or post-manufacture using specialized measurement equipment), display 120 (or 214, 1010 in FIG. 10) may be subject to gray tracking calibration while setting the white point of display 120 to respective different values. For each set white point, the gray tracking calibration may be performed in which colorimetric response display values of uncorrected RGB output data may be measured from the particular display device while inputting voltages for different gray intensity levels from black to the set white point. The measured values may be compared to corresponding 'reference' colorimetric response values to determine 'delta' values representing a difference between the actual measured values and the 'reference' values. Thus, the 'delta' values may represent how the actual measured values deviate from the ideal. The 'delta' values may be used to generate pixel adjustment values (e.g., RGB adjustment values) that, when applied to pixel values, will produce the true (intended or ideal) gray levels across a full range from black to white on display 120, so that the shades of gray (e.g., linear range of R=G=B from 0 to 1) at different luminance levels will all appear to have the same hue as the hue for the set white point. The pixel adjustment values may be stored as a correction table (e.g., LUT) in calibration and measurement data 520. The process may then be repeated for other white points to generate respective correction tables representing gray tracking calibrations for respective different white points. Additional or alternative characteristics (e.g., temperature, black point, and the like) may also be changed while performing the calibration to generate corresponding LUTs in calibration and measurement data 520. In one embodiment, the sampling of white points (or other characteristics) for which the gray tracking calibration is to be performed and corresponding data stored as correction tables in calibration and measurement data 520 may be determined based on a dimensionality and range of values corresponding to the white point (or other display characteristics such as black point, gamma, and the like) that display device 120 may be capable of holding. For example, in the case of white point, the possible range of values of the white point of the display device (e.g., display 120, 214, 1010, and the like) may be a one-dimensional range specified in x-y chromaticity values along the black body curve.

Figure 6:
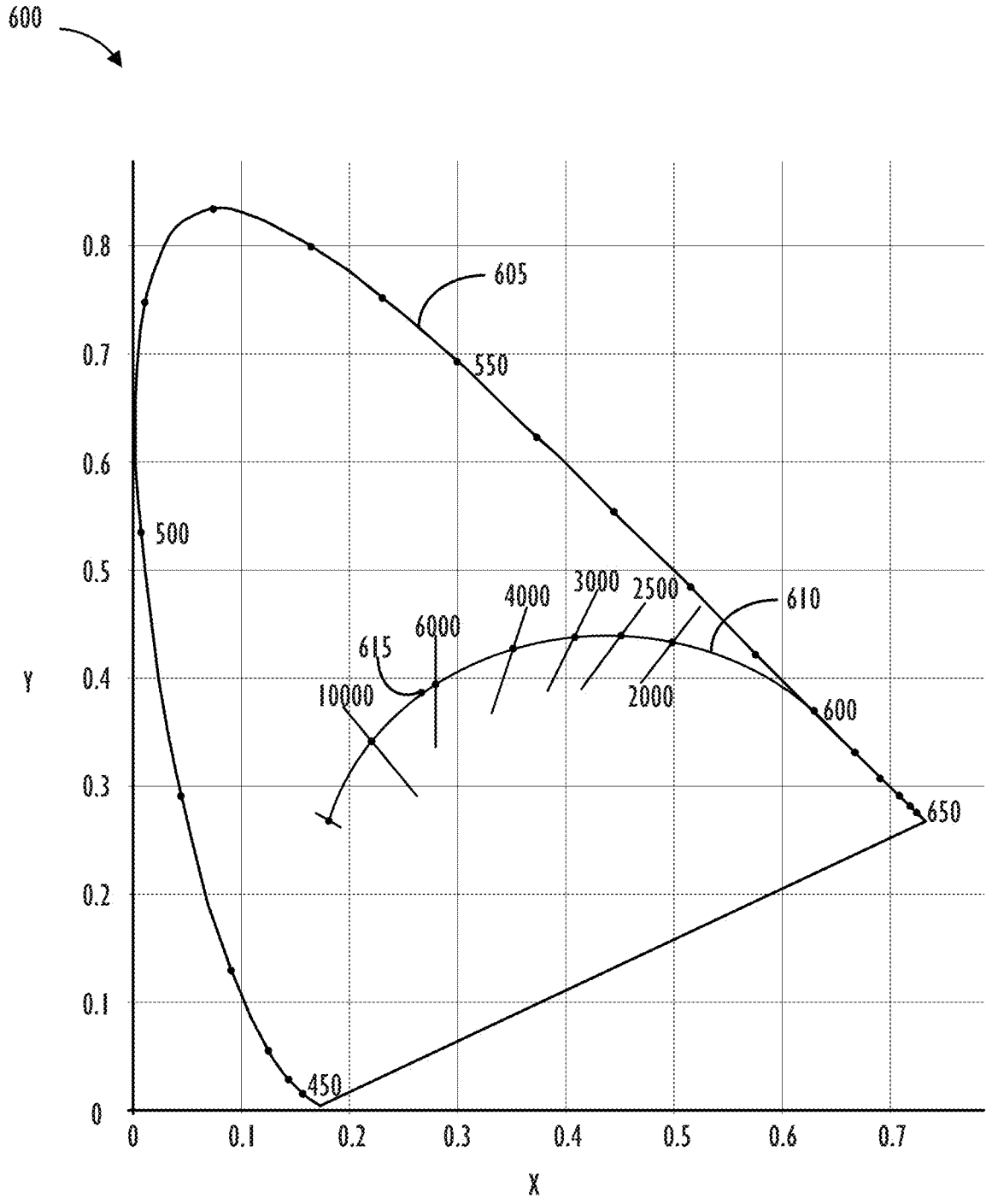
FIG. 6 illustrates the International Commission on Illumination (CIE) 1931 color space chromaticity diagram with the black body curve specified, in accordance with one or more embodiments.

FIG. 6 illustrates the CIE 1931 color space chromaticity diagram 600 with the black body curve 610 specified, in accordance with one or more embodiments. As shown in FIG. 6, outer curved boundary 605 represents the visible spectrum of monochromatic colors with wavelengths indicated in nanometers. The colors along outer curved boundary 605 progress through a range of purple, blue, green, yellow, orange, and red with increasing wavelength. Additionally, the chromaticity diagram 600 includes black body curve 610 which illustrates a chromaticity locus of the black body heated to a range of temperatures. Generally, a black body is known to one of ordinary skill in the art and may emit the same wavelength and intensity as absorbed by the black body in an environment in equilibrium at temperature T. The radiation in this environment may have a spectrum that depends only on temperature, thus the temperature of the black body in the environment may be directly related to the wavelengths of the light that it emits. For example, as depicted in FIG. 6, at around 1500 Kelvin, the color of the black body may be orangish-red. As the temperature increases and follows the black body curve 610 illustrated in FIG. 6, the color of the black body may change. Thus, around 3000 Kelvin, the color of the black body may be orange-yellow, around 5000 Kelvin the color may be yellow-green and around 6700 Kelvin the color may be white. The native white point is illustrated at 615.

Display 120 (or 214, 1010 in FIG. 10) may be configured to dynamically set (based on sensor data from sensors 160 or based on user operation) any point along (the one-dimensional) black body locus 610 as the white point of the display. In this case, the sampling of white points for which gray tracking calibration may be performed (and corresponding calibration data 520 stored) for this particular display may include points which are along black body locus 610, and may correspond to points at 2000, 2500, 3000, 4000, 6000, and 10000 Kelvin, as shown in FIG. 6.

In another embodiment, the display 120 (or 214, 1010 in FIG. 10) may be configured to dynamically set (based on sensor data from sensors 160 or based on user operation) a white point to be any point in a two-dimensional (or multi-dimensional) range. For example, the possible range of values of white point of the display device may be a two-dimensional range specified within a predetermined color space defined by x-y chromaticity values of the chromaticity diagram 600, as shown in FIG. 7.

Figure 7:
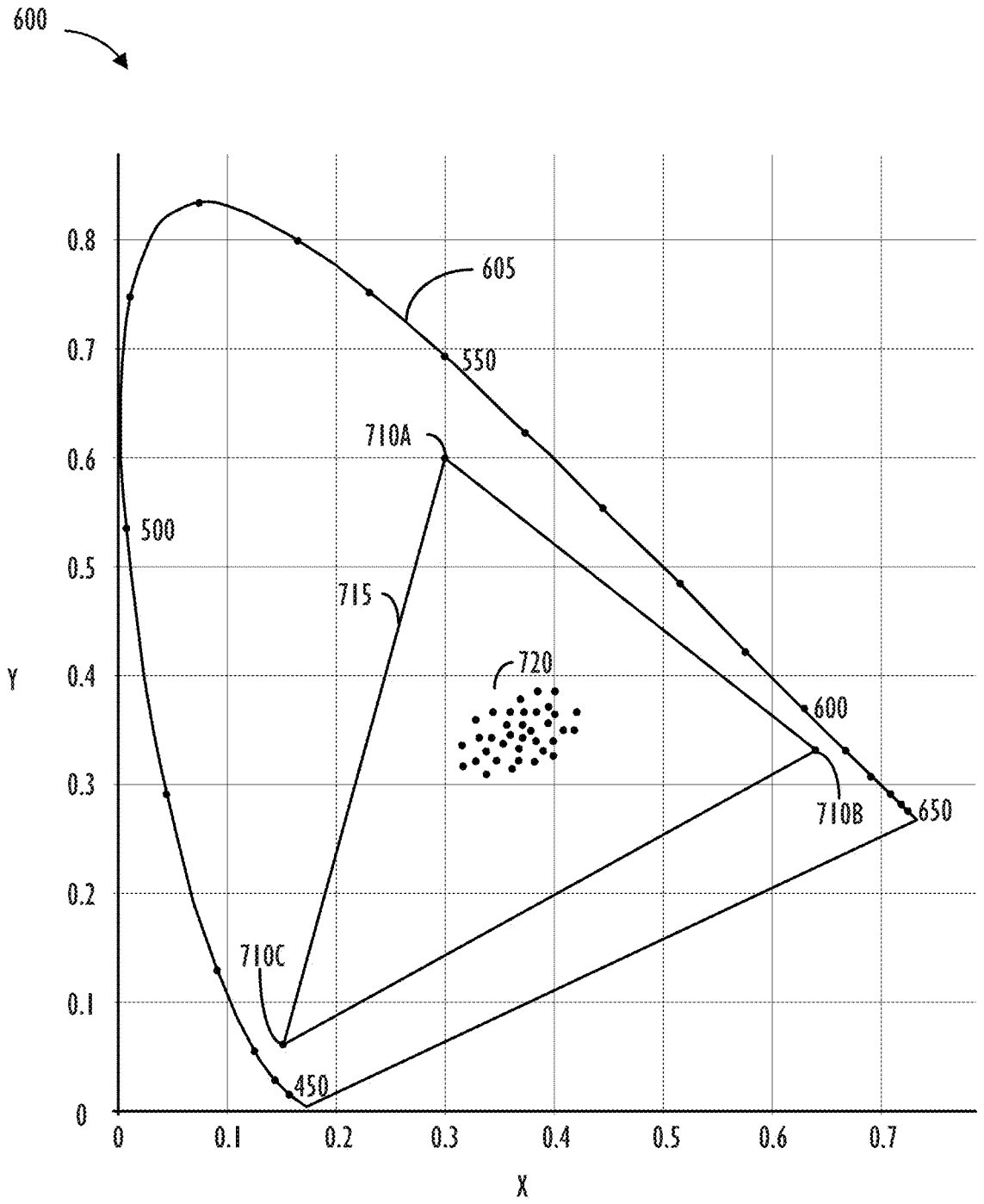
FIG. 7 illustrates the CIE 1931 color space chromaticity diagram with sampled white points for dynamic gray tracking specified, in accordance with one or more embodiments.

In FIG. 7, chromaticities of the red, green, and blue color primaries for a particular RGB color space (e.g., the chromaticity where one color channel has a nonzero value and the other two channels have zero values) form the vertices of color triangle 715. The gamut of chromaticities that can be represented by the RGB color space are represented by the chromaticities that are within color triangle 715. Color triangle 715 corresponds to the sRGB color space, the most common of the RGB color spaces. Vertex 710A is the sRGB red primary, vertex 710B is the sRGB green primary, and vertex 710C is the sRGB blue primary. In the sRGB color space shown in FIG. 7, for example, any chromaticity within the two-dimensional color triangle 715 may be settable as the white point of the display device implementing this color space. In this case, an exemplary sampling of white points for which the gray tracking calibration may be performed (and corresponding calibration data 520 stored as correction tables) for this particular display may include the cluster of white points represented by element 720 in FIG. 7.

Returning to FIG. 5, based on stored calibration and measurement data 520, and based on dynamic (currently set) display characteristics 510 and static display characteristics 511 (e.g., RGB color primaries, native white point, transfer functions, and the like), dynamic gray tracking engine 515 corrects input content 505 to generate output content 550 in which pixel values to be applied to a plurality of pixels of the display device are corrected based on pixel adjustment values 530 implemented as LUTs or a parametric solution. In one embodiment, pixel adjustment values 530 may be RGB adjustment values derived by interpolation module 525 via interpolation from calibration data 520.

Input content 505 may include any content to be displayed on the display. For example, input content 505 may correspond to content output from framebuffer 208 shown in FIG. 2 to drive a video display with a complete frame of image data. In one embodiment, input content 505 may be RGB data to be displayed on the display. Dynamic display characteristics 510 may correspond to a current set (and dynamically changeable) state of the display device as represented by one or more values of display characteristics of the display device. For example, dynamic display characteristics 510 may specify current and dynamically changing values of one or more of the white point, black point, gamma, temperature, and the like, of display 120. As explained above, dynamic display characteristics 510 may change depending on user operation or setting, sensor data from sensors 160, and the like. Static display characteristics 511 may correspond to static display characteristics of the display device like RGB primaries, native white point, transfer functions, and the like.

Based on static and dynamic display characteristics 510 and 511, dynamic gray tracking engine 515 may access relevant calibration data 520 of one or more correction tables to update gray tracking of the particular display device. For example, based on a value (e.g., x-y chromaticity value) of a current set white point as a display characteristic, dynamic gray tracking engine 515 may access calibration data 520 of a correction table that corresponds to the current set white point. If such correction table is not available (e.g., calibration based on actual measured values for the current set white point has not been performed), dynamic gray tracking engine 515 may access calibration data 520 of two or more correction tables whose respective white point values are closest to the white point value of the current set white point. For example, when the white point is settable to be any value along black body curve 610 shown in FIG. 6, and when calibration data that specifically corresponds to the specific set current white point (which could be a target white point (e.g., white point 615 in FIG. 6), or any other white point along black body curve 610) is not available in calibration data 520, interpolation module 525 may access data 520 of two calibration tables or a function of the two tables whose respective white point values along black body locus 610 (representing a one-dimensional space) are closest to the current set white point value. Interpolation module 525 may then perform bi-linear weighted interpolation based on data 520 of the two correction tables or function of the tables to derive an interpolated correction table including pixel (e.g., RGB) adjustment values 530 that corresponds to the current set white point. Alternately, interpolation module 525 may generate a parametric solution based on the interpolation and additional analysis.

As another example, when the white point is settable to be any value in a 2D space within color space 715 shown in FIG. 7, and when calibration data 520 that specifically corresponds to the current set white point is not available in calibration and measurement data 520, interpolation module 525 may access data 520 of three or more calibration tables whose respective white point values are closest to the current set white point value. Interpolation module 525 may then perform tri-linear, multi-linear, or tetrahedral interpolation based on the three or more correction tables to derive an interpolated correction table including pixel (e.g., digital values for RGB) adjustment values 530 that corresponds to the current set white point. Alternately, interpolation module 525 may generate a parametric solution based on the interpolation and additional analysis.

In one embodiment, pixel adjustment values 530 may be in the form of a LUT (e.g., 1D LUT for each of red, green and blue, 3D LUT, and the like). Alternately, pixel adjustment values 530 may be implemented as a matrix, parametric solution, function, or other suitable implementation to correct pixel values before output to the display. In addition, although the above examples illustrate accessing calibration data 520 based on respective associated white point values and deriving pixel adjustment values 530 based on the current set white point value, functionality of dynamic gray tracking engine 515 is not so limited. For example, calibration data 520 of each correction table may have additional or alternative corresponding display characteristic values such as respective white point values, respective black point values, respective gamma values, respective temperatures, and the like. Further dynamic (current set) display characteristics 510 may also include one or more of current set white point value, current set black point value, current temperature, current set gamma, and the like. And based on one or more of the current set display characteristic values, calibration data from one or more correction tables having closest corresponding characteristic values may be accessed to derive pixel adjustment values 530 via interpolation module 525. Thus, dynamic gray tracking engine 515 may update the gray tracking based on a change in any of white point, black point, gamma, temperature, and the like, of the display device.

Gray gradient correction generator 535 may apply derived pixel adjustment values 530 to input content 505 to generate output content 550. For example, a different gray gradient (or vector) going from black to a current set white point (or any color set as the current white point) may be applied to each of red, green, and blue channels based on the derived pixel adjustment values 530.

As explained earlier, colors may 'flash' (or 'pop') when processing of output content 550 is suddenly switched from being performed with a new gray gradient (vector) that is based on current set display characteristics. For example, when the white point is moved to a new white point, colors in output content 550 may 'pop' if processing of content 550 is instantaneously switched to be performed using a new gray gradient generated by gray gradient correction generator 535 corresponding to the new white point. In one embodiment, animation engine 540 may animate the change in the gray gradient (e.g., pixel adjustment values 530) smoothly over a predetermined period of time. For example, animation engine 540 may linearly interpolate (LERP) along pixel adjustment values (LUTs or parametric solution) 530 smoothly from pixel adjustment values 530 based on previous display characteristics 510 (e.g., previous white point) to new pixel adjustment values 530 derived by interpolation module 525 to correspond to a dynamically changed and current display characteristic 510 (e.g., new set white point), so as to smoothly animate changes between the pixel adjustment values.

Smoothly transitioning between adjustment values from 'current' values to 'target' values via LERPed values (e.g., intermediary correction tables) may ensure that even if the LERPed values do not accurately adjust the gray tracking based on the current display state, the gray tracking gradient (and corresponding hues at different gray levels) would shift smoothly over a period of time imperceptibly to a viewer of the display (e.g., without being noticeable to the viewer or without calling the viewer's attention). That is, since pixel adjustment values 530 may be derived via interpolation by interpolation module 525, and since the source from which pixel adjustment values 530 are derived (e.g., calibration data 520) may itself, at least partially, be the result of interpolation, pixel adjustment values 530 may not be completely accurate. And snapping instantly to the derived pixel adjustment values 530 may cause 'flashing'. Instead, by utilizing animation engine 540 to smoothly animate from 'current' values to the 'target' values as if there were multiple LERPed intermediate steps, change caused by each step being imperceptible to the previous step, would prevent drawing unnecessary attention from the viewer and gradually update gray tracking of the display to the 'target' values (e.g., LUTs, gray gradient, gray vector, and the like). The time period over which animation engine 540 may smoothly animate from the 'current' values to the 'target' values may be set to be long enough so that the changes to the displayed color remain imperceptible to the viewer. Further, the number of LERPed intermediate steps may be set to be as few as possible between the 'current' and 'target' values so that each step is 'sub-JND' to keep the changes to the displayed color imperceptible to the viewer. Animation engine 540 may also apply the smoothing animation techniques thereof via panel self-refresh so as not to wake or burden the CPU. For example, animation engine 540 may implement the smoothing animation techniques in the TCON chip or another hardware chip in the display device itself, such that the perceptually smooth animation between gray tracking correction vectors may be imlemented without waking up a host CPU of a computer system coupled to the display device.

Figure 8:
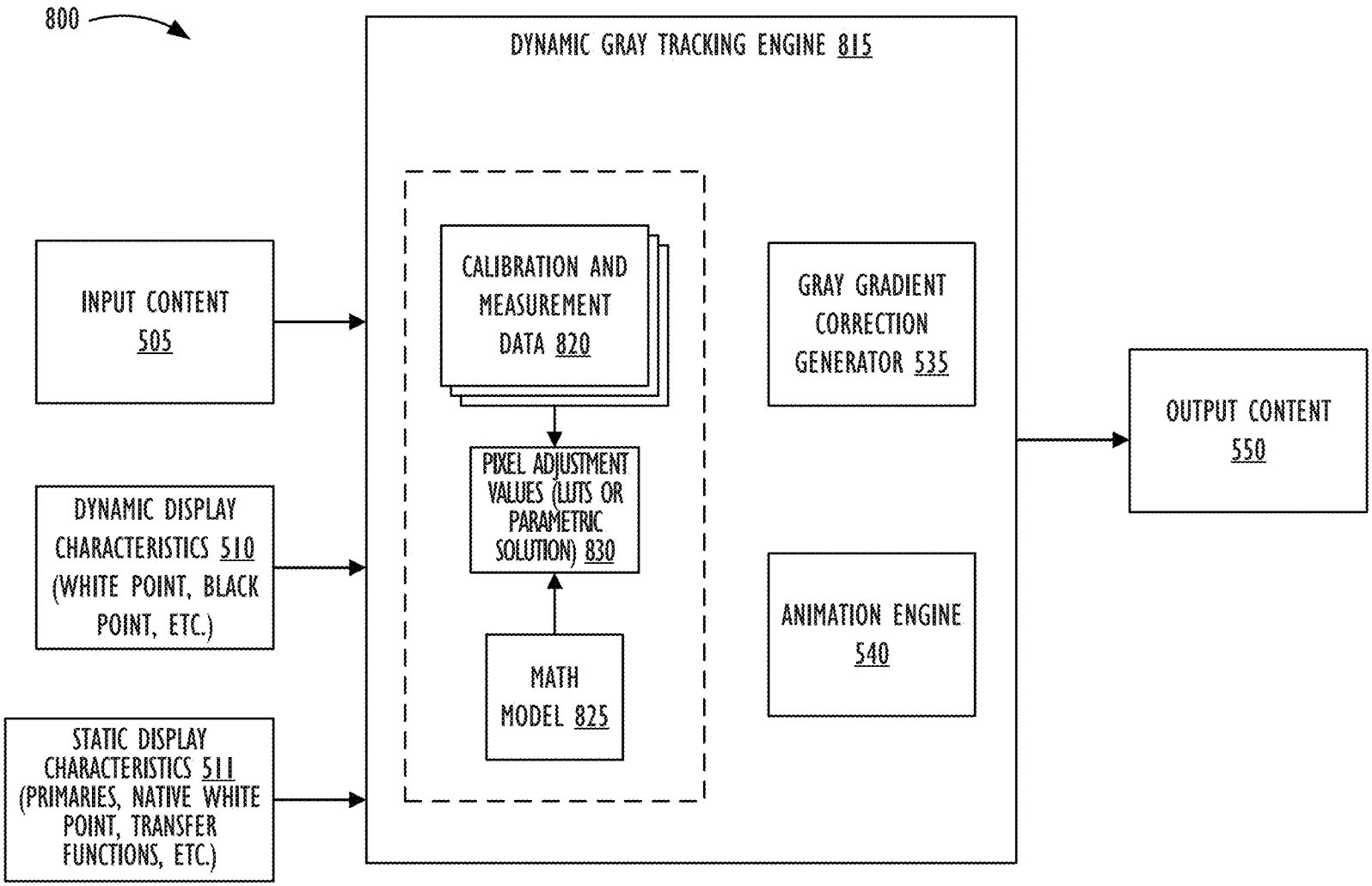
FIG. 8 illustrates system for performing dynamic gray tracking, in accordance with one or more embodiments.

FIG. 8 illustrates system 800 for performing dynamic gray tracking, in accordance with one or more embodiments. Components of system 800 of FIG. 8 that are similar to those of system 500 of FIG. 5 are marked with the same reference numerals not are described below in further detail.

In contrast to system 500 shown in FIG. 5, rather than generating pixel adjustment values based on interpolation of calibration data 520, 820, system 800 shown in FIG. 8 generates mathematical model 825 that updates gray tracking based on current display characteristics 510. That is, rather than interpolating calibration data 520, 820, system 800 creates a mathematical expression during calibration that can act as model 825 to represent primary, secondary, and/or tertiary factors that cause the gray tracking to 'break' when dynamic display characteristics 510 change or are moved.

It has been unexpectedly discovered that crosstalk between channels (e.g., crosstalk between red, green and blue sub-pixels) is one of the primary factors that causes the gray tracking to 'break' when dynamic display characteristics 510 (e.g., white point) change or are moved. The sub-pixel crosstalk may originate from a variety of sources including mechanical coupling between channels (or sub-pixels), electromagnetic coupling or interference between channels, electrical coupling, mechanical coupling, thermal coupling, optical leakage between pixels in color LCDs, and the like.

Further, it has been unexpectedly discovered that another primary factor that causes the gray tracking to 'break' is associated with quarter wavelength issues. One example of quarter wavelength shutter issues relate to a phenomenon in which as an LCD shutter is opened to smaller portions, the shutter begins to provide filtration on the back light that actually warps through, thereby changing the spectrum of light output from the display device.

Mathematical model 825 may be developed based on calibration and measurement data 820 that encapsulates these primary factors without having to explicitly model (e.g., measure) each primary factor individually. In one embodiment, math model 825 may be a polynomial model (or equation) of order n that captures the highest non-linearity and that is trained using calibration and measurement 820 that include calibration data representing optimized measurements across white points and component brightness levels (or alternative/additional dynamic display characteristics 510), and then solving for coefficients in the polynomial equation. After developing and training math model 825, as the white point or other display characteristic 510 is dynamically moved or changed, dynamic gray tracking engine 815 may utilize math model 825 (which is very compact as compared to interpolated LUTs 530 or calibration data 520, 820) to compute pixel adjustment values 830 as a gray tracking correction table (e.g., 1D LUT, 3D LUT, and the like) or a parametric solution, based on math model 825.

In one embodiment, math model 825 may be implemented as a system of equations in which variables may represent one or more primary factors. For example, the system of equations may model a linear system in which various sources of sub-pixel crosstalk have an additive effect on output (e.g., energizing one channel has an additive effect on another channel). An exemplary linear crosstalk system underlying math model 825 is illustrated below.

$$Re=Rd+GR*Gd+BR*Bd$$

$$Ge=RG*Rd+Gd+BG*Bd$$

$$Be=RB*Rd+GB*Gd+Bd$$

In the above crosstalk system, Re represents effective red, Rd represents desired red, Ge represents effective green, Gd represents desired green, Be represents effective blue, and Bd represents desired blue. Further, GR represents effect of the green sub-pixel (or channel) on the red sub-pixel (or channel), BR represents effect of the blue sub-pixel (or channel) on the red sub-pixel (or channel), RG represents effect of the red sub-pixel (or channel) on the green sub-pixel (or channel), BG represents effect of the blue sub-pixel (or channel) on the green sub-pixel (or channel), RB represents effect of the red sub-pixel (or channel) on the blue sub-pixel (or channel), and GB represents effect of the green sub-pixel (or channel) on the blue sub-pixel (or channel). The six coefficients GR, BR, RG, BG, RB, and GB are solved for in the calibration process, or based on the data captured at calibration.

In one embodiment, math model 825 may be trained by taking measurements that solve simultaneous equations for the six coefficients in crosstalk correlation in the exemplary linear crosstalk system identified above. Trained math model 825 may then be utilized to build (synthesize) 3×1D LUTs for red, green, and blue color channels, 3D LUT, or a parametric solution 830 implemented as a shader or bespoke hardware to correct gray tracking for any specific white point or other dynamic display characteristic 510 (e.g., black point, temperature, gamma, and the like) set for the particular display device. Math model 825 may further be trained to consider asymmetricity of the effect between sub-pixels, and/or that driving one sub-pixel might have a negative influence on driving an adjacent sub-pixel. Thus, math model 825 may be able to account for constant changes in as many characteristics 510 as desired and dynamically synthesize a LUT or parametric solution 830. In one embodiment, math model 825 may be updated so that as phenomena of additional primary, secondary, or tertiary factors that cause gray tracking to 'break' become well understood, the additional factors may be modeled as well based on additional independent measurements to control pixel adjustment values 830 for the additional factors.

Math model 825 may also be built as an analytical model, artificial intelligence model, polynomial model, function, or the like, based on the actually measured calibration data 520 of multiple correction tables of FIG. 5 corresponding to multiple dynamic display characteristics 510. That is, actually measured calibration data 520 of correction tables as anchor tables that represent 'truth' may be used to solve for math model 825 to derive a generalized set of equations which may then be used to update gray tracking for any white point or other dynamic display characteristic 510, or any other intermediate point or value of dynamic display characteristic 510 within a given space. Math model 825 may be created once, a priori, for multiple display devices, based on extensive measurements of one or a small set of display devices. During factory calibration, math model 825 may then be further fine-tuned or modified by making relatively few measurements so as to customize math model 825 for variations specific to the display device corresponding to system 800, thereby providing a robust and customized model 825 for individual display devices while maintaining as lightweight a measurement impact as possible at manufacturing or further calibration time.

In one embodiment, the precision of interpolated or computed pixel adjustment values in LUTs 530, 830 (e.g., number of bits per code) may be higher than what the display device may be capable of displaying. Image processing techniques such as spatial or temporal dithering, frame rate control, and the like may then be utilized by a display driver to display on the display device output content 550 that has been corrected using LUTs 530, 830 with the higher precision. Spatial or temporal dithering techniques may also be utilized when animation engine 540 smoothly animates from 'current' values to the 'target' values via multiple LERPed intermediate steps so that the changes to the displayed color remain imperceptible to the viewer. For example, if animation engine 540 determines that finer grained multiple LERPed intermediate steps are required to achieve 'sub-JND' gray tracking correction vectors for a system implemented to have a given precision level, animation engine 540 may employ spatial or temporal dithering to generate these 'partial' intermediate steps. In one embodiment, the dither could be of a pre-truncation, non-subtractive type, and may be applied spatially (such that identical neighboring pixels would stochastically resolve to different values), or temporally (such that successive, potentially identical frames, would stochastically resolve to different values). In either case, a reconstruction filter (inherent in human perception, and possibly in the physics of the display device) would integrate to the desired higher precision intermediate step.

Elements 530, 830 may also be implemented as a parametric solution instead of synthesizing or interpolating a correction table. That is, instead of storing calibration and measurement data 520, 820 as correction tables, the data may be analyzed and a parametric representation (e.g., system of equations) of the tables based on the analysis may be created, stored, and utilized for calculating adjustment values 530, 830 for any dynamic display characteristic 510 such as white point, black point, gamma, temperature, and the like. For example, coefficients of math model 825 may dynamically modify pixel values based on changing display characteristics 510 via a shader or other custom hardware, without utilizing a LUT.

Figure 9:
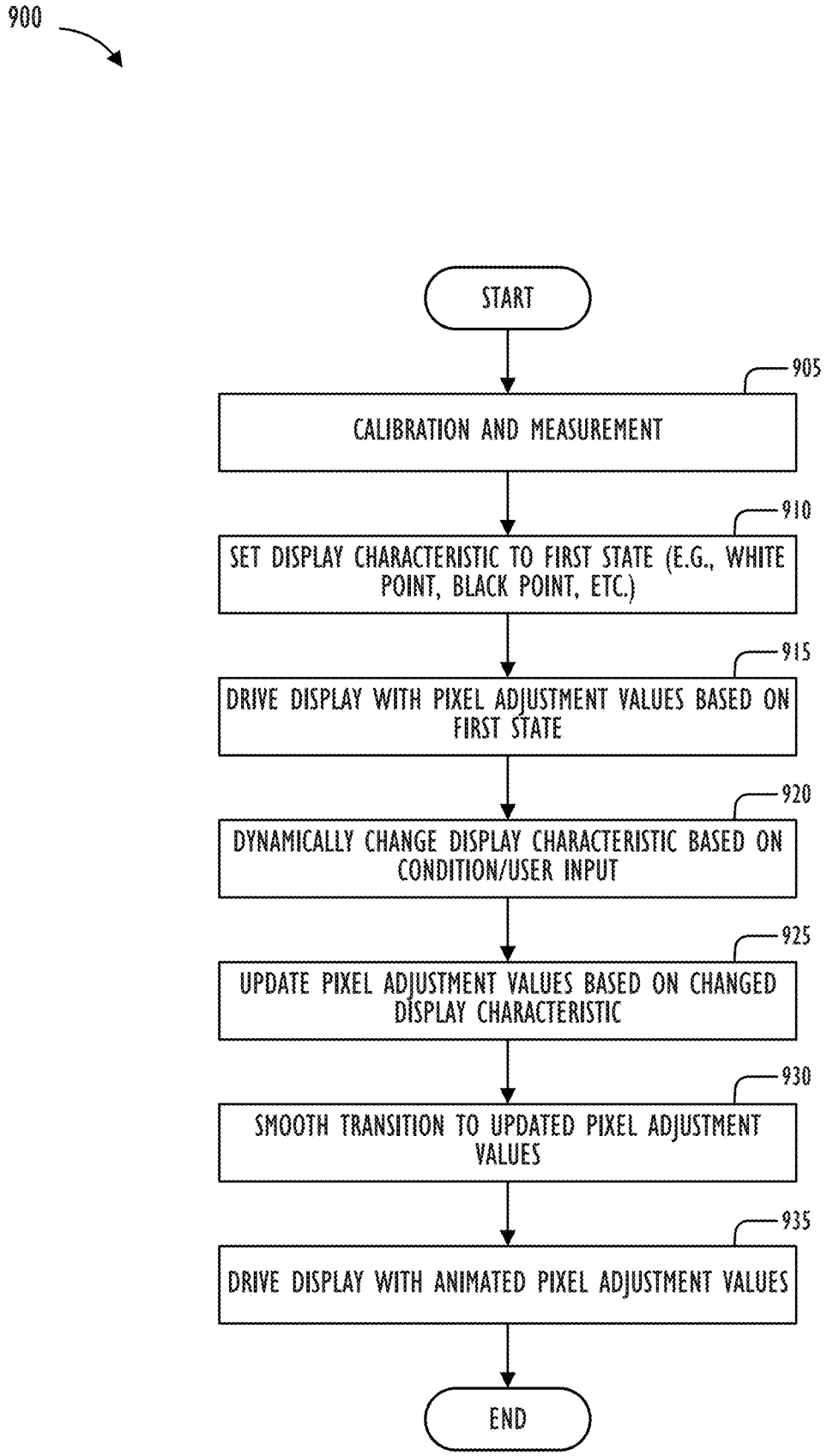
FIG. 9 illustrates, in flowchart form, a process for performing dynamic gray tracking, in accordance with one or more embodiments.

FIG. 9 illustrates, in flowchart form, a process 900 for performing dynamic gray tracking, in accordance with one or more embodiments. At block 905, the display device (e.g., display 120, 214, 1010 in FIG. 10, and the like) may be subject to calibration and measurement in a factory during production (or post-production using specialized calibration equipment) to generate calibration and measurement data 520, 820 specific to the display device. As explained above, the calibration and measurement data may be generated for the display device having respective different display characteristics 510. The data may then be stored (e.g., in memory 150, storage 155, and/or in hardware, firmware, or memory within the display device itself) in the form of one or more LUTs, or matrices. Alternately, the data may be analyzed and stored as a parametric representation, or a math function.

At block 910, electronic device 100 may set one or more display characteristics (e.g., white point, black point, gamma, display panel temperature) to a first state based on sensor 160 data. Based on the set display characteristics, at block 915, dynamic gray tracking engine 515, 815 may drive the display device so that input content 505 pixel values are corrected using pixel adjustment values 530, 830 (derived via interpolation or computation) to output content 550 pixel values for output to display 120. At block 920, electronic device 100 may dynamically change one or more display characteristics 510 based on user operation or sensor 160 data. For example, electronic device 100 may detect an updated temperature reading of the display panel or may change the white point based on data from an ambient light sensor. Based on the updated display characteristics, at block 925, dynamic gray tracking engine 515, 815 may update the gray tracking using calibration and measurement data 520, 820 or based on math model 825 derived therefrom to update pixel adjustment values 530, 830. The updated correction values or equations may then be used to correct pixel values of input content 505 to generate corrected output content 550. At block 930, animation engine 540 may animate the changes to the adjustment values over time to smooth the transition from utilizing the previous pixel adjustment values or equations 530, 830 to the updated pixel adjustment values or equations 530, 830, so as to avoid drawing viewer's attention to the changing gray level hues based on the updated gray tracking. At block 935, a display driver may drive the display with the updated pixel adjustment values 530, 830 with the smoothing animation over a short period of time by animation engine 540.

Figure 10:
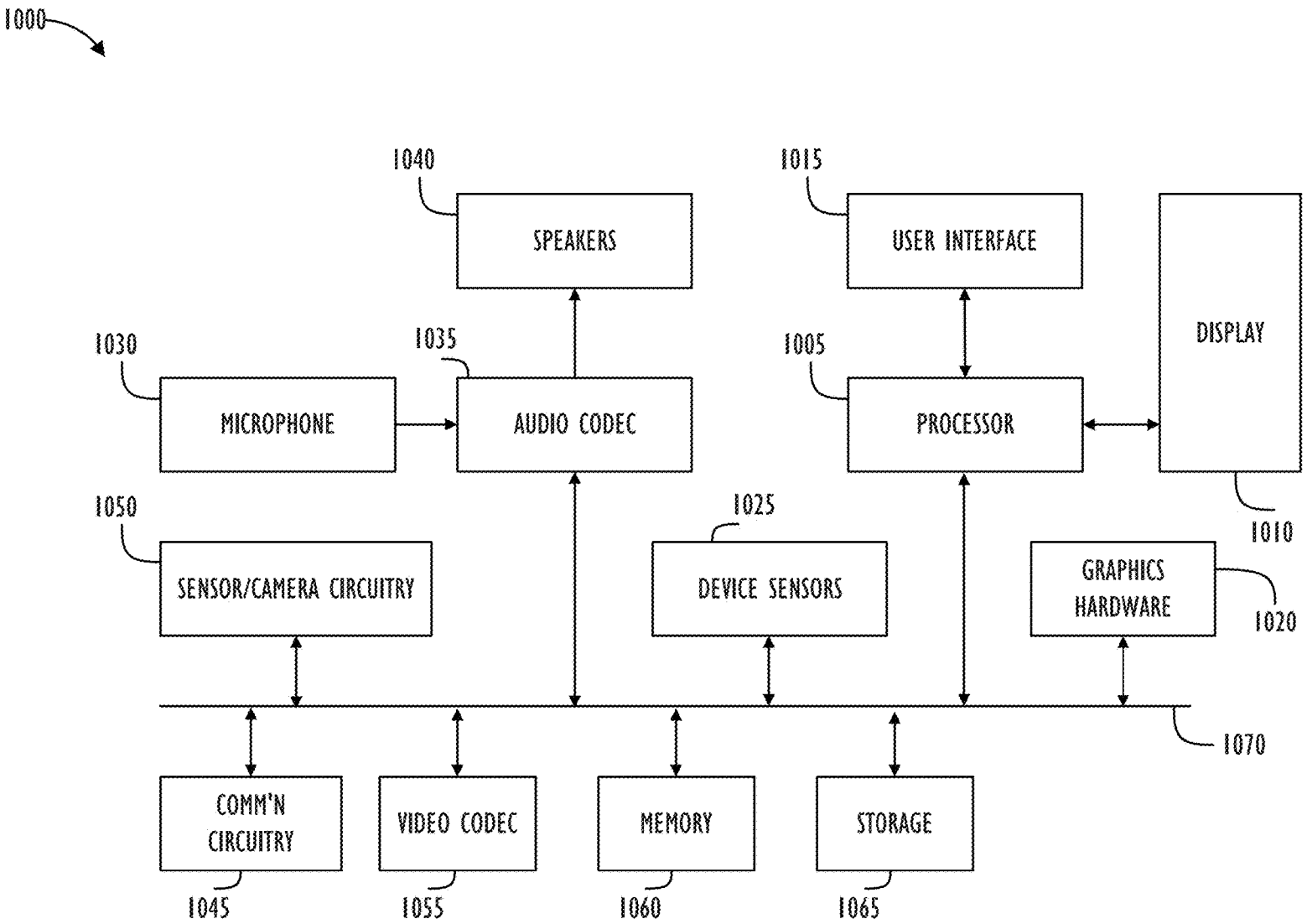
FIG. 10 is a simplified functional block diagram of an illustrative multi-functional electronic device.

Referring to FIG. 10, a simplified functional block diagram of illustrative device 1000 that corrects gray tracking as described in FIGS. 5-9 is shown. Device 1000 may include processor 1005, display 1010, user interface 1015, graphics hardware 1020, device sensors 1025 (e.g., proximity sensor/ambient light sensor, accelerometer and/or gyroscope), microphone 1030, audio codec(s) 1035, speaker(s) 1040, communications circuitry 1045, sensor and camera circuitry 1050, video codec(s) 1055, memory 1060, storage 1065, and communications bus 1070. Electronic device 1000 may be, for example, a digital camera, a personal digital assistant (PDA), personal music player, mobile telephone, server, notebook, laptop, desktop, or tablet computer. More particularly, the disclosed techniques may be executed on a device that includes some or all of the components of device 1000.

Processor 1005 may execute instructions necessary to carry out or control the operation of many functions performed by a multi-functional electronic device 1000 (e.g., such as gray tracking correction). Processor 1005 may, for instance, drive display 1010 and receive user input from user interface 1015. User interface 1015 can take a variety of forms, such as a button, keypad, dial, a click wheel, keyboard, display screen and/or a touch screen. Processor 1005 may be a system-on-chip such as those found in mobile devices and include a dedicated graphics-processing unit (GPU). Processor 1005 may represent multiple central processing units (CPUs) and may be based on reduced instruction-set computer (RISC) or complex instruction-set computer (CISC) architectures or any other suitable architecture and each may include one or more processing cores. Graphics hardware 1020 may be special purpose computational hardware for processing graphics and/or assisting processor 1005 process graphics information. In one embodiment, graphics hardware 1020 may include one or more programmable graphics-processing unit (GPU), where each such unit has multiple cores.

Sensor and camera circuitry 1050 may capture still and video images that may be processed to generate images in accordance with this disclosure. Sensor in sensor and camera circuitry 1050 may capture raw image data as red, green, and blue (RGB) data that is processed to generate an image. Output from camera circuitry 1050 may be processed, at least in part, by video codec(s) 1055 and/or processor 1005 and/or graphics hardware 1020, and/or a dedicated image-processing unit incorporated within camera circuitry 1050. Images so captured may be stored in memory 1060 and/or storage 1065. Memory 1060 may include one or more different types of media used by processor 1005, graphics hardware 1020, and camera circuitry 1050 to perform device functions. For example, memory 1060 may include memory cache, read-only memory (ROM), and/or random access memory (RAM). Storage 1065 may store media (e.g., audio, image and video files), computer program instructions or software, preference information, device profile information, and any other suitable data. Storage 1065 may include one more non-transitory storage mediums including, for example, magnetic disks (fixed, floppy, and removable) and tape, optical media such as compact disc-ROMs (CD-ROMs) and digital video disks (DVDs), and semiconductor memory devices such as Electrically Programmable Read-Only Memory (EPROM), and Electrically Erasable Programmable Read-Only Memory (EEPROM). Memory 1060 and storage 1065 may be used to retain computer program instructions or code organized into one or more modules and written in any desired computer programming language. When executed by, for example, processor 805 such computer program code may implement one or more of the methods described herein.

Figure 11:
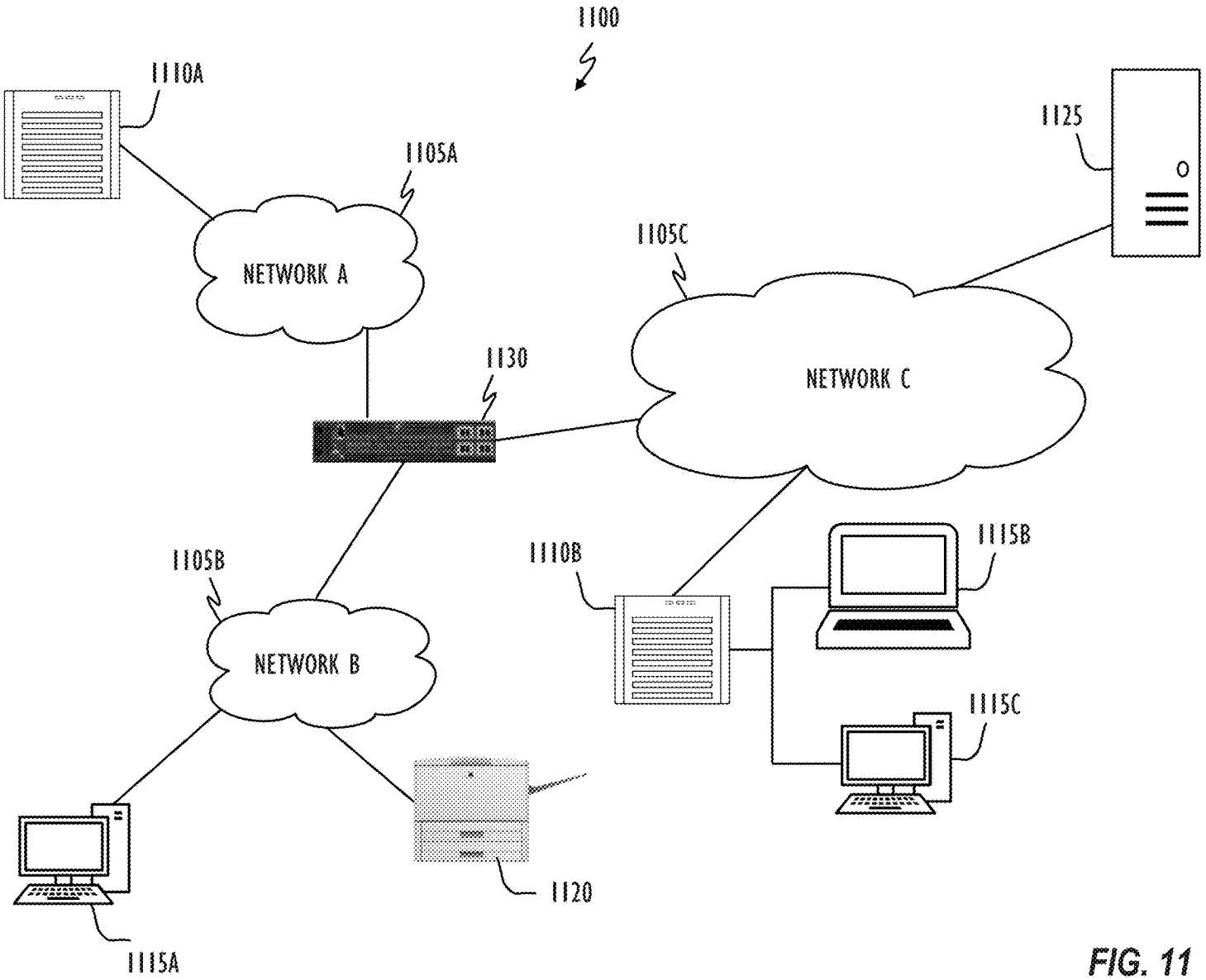
FIG. 11 shows, in block diagram form, a computer network, in accordance with one or more embodiments.

Referring to FIG. 11, illustrative network architecture 1100 within which an information display system in accordance with the disclosed techniques may be implemented includes a plurality of networks 1105, (e.g., 1105A, 1105B and 1105C), each of which may take any form including, but not limited to, a local area network (LAN) or a wide area network (WAN) such as the Internet. Further, networks 1105 may use any desired technology (wired, wireless or a combination thereof) and communication protocol (e.g., TCP, or transmission control protocol and PPP, or point to point). Coupled to networks 1105 are data server computer systems 1110 (e.g., 1110A and 1110B) that are capable of communicating over networks 1105. Also coupled to networks 1105, and/or data server computer systems 1110, are client or end-user computer systems 1115 (e.g., 1115A, 1115B and 1115C). Each of these elements or components may be a computer system or electronic device as described above with respect to FIGS. 1 and 10. In some embodiments, network architecture 1100 may also include network printers such as printer 1120 and network storage systems such as 1125. To facilitate communication between different network devices (e.g., server computer systems 1110, client computer systems 1115, network printer 1120 and storage system 1125), at least one gateway or router 1130 may be optionally coupled there between.

As used herein, the term "computer system" or "computing system" refers to a single electronic computing device or to two or more electronic devices working together to perform the function described as being performed on or by the computing system. This includes, by way of example, a single laptop, host computer system, wearable electronic device, and/or mobile device (e.g., smartphone, tablet, and/or other smart device).

It is to be understood that the above description is intended to be illustrative, and not restrictive. The material has been presented to enable any person skilled in the art to make and use the claimed subject matter as described herein, and is provided in the context of particular embodiments, variations of which will be readily apparent to those skilled in the art (e.g., some of the disclosed embodiments may be used in combination with each other). For example, while FIGS. 5-9 have been described in the context of gray tracking correction within a display device, gray tracking correction is not limited to a display device, but instead can involve other output devices. In addition, some of the described operations may have their individual steps performed in an order different from, or in conjunction with other steps, than presented herein. More generally, if there is hardware support some operations described in conjunction with FIGS. 1 and 10 may be performed in parallel.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations may be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). The use of the term "about" means ±10% of the subsequent number, unless otherwise stated.

Many other embodiments will be apparent to those of skill in the art upon reviewing the above description. The scope of the invention therefore should be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A non-transitory program storage device, readable by one or more programmable control devices and comprising instructions stored thereon to cause the one or more programmable control devices to:

set an output device to a first state in which a value of a first characteristic of the output device is set to a first value;

set pixel adjustment values for each of a plurality of gray levels to first pixel adjustment values in response to the output device being set to the first state, wherein the first pixel adjustment values are based on actual values for each of the plurality of gray levels measured during a calibration process when the first characteristic of the output device is set to the first value;

change the value of the first characteristic of the output device from the first value to a second value to set the output device to a second state;

update the pixel adjustment values for each of the plurality of gray levels to second pixel adjustment values in response to the output device being set to the second state via a dynamic gray tracking operation, wherein the second pixel adjustment values are dynamically derived based on the second value of the first characteristic of the output device and based on the first pixel adjustment values; and correct pixel values applied to a plurality of pixels of the output device based on the second pixel adjustment values.

2. The non-transitory program storage device of claim 1, wherein the first characteristic comprises at least one of a white point, a black point, gamma, and a thermal component, of the output device.

3. The non-transitory program storage device of claim 2, wherein the instructions that cause the one or more programmable control devices to update the pixel adjustment values for each of the plurality of gray levels comprise instructions that cause the one or more programmable control devices to:

access a plurality of measured correction tables of pixel adjustment values for each of the plurality of gray levels, the plurality of correction tables respectively corresponding to different values of the first characteristic of the output device, wherein the first pixel adjustment values are included in one of the plurality of measured correction tables that corresponds to the first value of the first characteristic of the output device; and interpolate pixel adjustment values of two or more correction tables from among the plurality of correction tables to generate the second pixel adjustment values in response to the output device being set to the second state.

4. The non-transitory program storage device of claim 3, wherein the instructions that cause the one or more programmable control devices to access the plurality of correction tables of pixel adjustment values comprise instructions that cause the one or more programmable control devices to:

measure, for each of the respective values of the first characteristic of the output device, actual pixel response of the output device for gray levels to generate the plurality of correction tables of pixel adjustment values, wherein the respective values correspond to a plurality of white points of the output device set in a one-dimensional space, and wherein the interpolation comprises bi-linear interpolation of a weighted average of correction tables of two of the plurality of white points which are closest to a target white point to which the output device is set in the second state.

5. The non-transitory program storage device of claim 3, wherein the instructions that cause the one or more programmable control devices to access the plurality of correction tables of pixel adjustment values comprise instructions that cause the one or more programmable control devices to:

select, as the respective values of the first characteristic of the output device, values of a plurality of sample white points of the output device in a multi-dimensional space; and measure, for each of the plurality of sample white points, actual pixel response of the output device for gray levels to generate the plurality of correction tables of pixel adjustment values, and wherein the interpolation comprises multi-linear interpolation of a weighted average of correction tables of three or more of the plurality of sample white points which are closest to a target white point to which the output device is set in the second state.

6. The non-transitory program storage device of claim 2, wherein the instructions that cause the one or more programmable control devices to correct pixel values applied to a plurality of pixels comprise instructions that cause the one or more programmable control devices to:

generate a plurality of intermediary correction tables based on correction tables of the first and second pixel adjustment values; and smooth, in response to determining that the output device is set to the second state, a transition through the plurality of intermediary correction tables over a predetermined period of time to animate the correction of the pixel values successively based on the correction table of the first pixel adjustment values, the plurality of intermediary correction tables, and the correction table of the second pixel adjustment values.

7. The non-transitory program storage device of claim 6, wherein the predetermined period of time is set to be longer than a threshold time so that a change in a display color due to the transition from utilizing the first pixel adjustment values to the second pixel adjustment values remains imperceptible to a viewer.

8. The non-transitory program storage device of claim 6, wherein a number of the plurality of intermediary correction tables to be generated is set so that a change in a display color caused by successively transitioning between each intermediary correction table remains imperceptible to a viewer.

9. The non-transitory program storage device of claim 6, wherein the instructions that cause the one or more programmable control devices to correct pixel values applied to a plurality of pixels further comprise instructions that cause the one or more programmable control devices to apply spatial or temporal dithering to animate the correction of the pixel values successively based on the plurality of intermediary correction tables.

10. The non-transitory program storage device of claim 6, wherein the plurality of intermediary correction tables are generated, and the transition through the plurality of intermediary correction tables is smoothed, via a hardware chip in a display device, without waking a host CPU.

11. The non-transitory program storage device of claim 2, wherein the instructions further cause the one or more programmable control devices to apply, in response to the value of the first characteristic of the output device being changed to the second value, a mathematical model to update the pixel adjustment values for each of the plurality of gray levels to the second pixel adjustment values.

12. The non-transitory program storage device of claim 11, wherein the instructions that cause the one or more programmable control devices to apply the mathematical model comprise instructions that cause the one or more programmable control devices to:

measure, for each of a plurality of values of the first characteristic of the output device, actual pixel response of the output device for gray levels;

create the mathematical model based on the measured actual pixel response for each of the plurality of values of the first characteristic; and apply the mathematical model to dynamically generate pixel adjustment values for a given input value of the first characteristic.

13. The non-transitory program storage device of claim 12, wherein the instructions that cause the one or more programmable control devices to create the mathematical model comprise instructions that cause the one or more programmable control devices to fine tune an existing mathematical model based on the measured actual pixel response for each of the plurality of values of the first characteristic.

14. The non-transitory program storage device of claim 12, wherein the mathematical model is at least one of a polynomial model, an analytical model, an artificial intelligence model, and a function including one or more variables that solves for coefficients of the one or more variables.

15. The non-transitory program storage device of claim 2, wherein the instructions that cause the one or more programmable control devices to change the value of the first characteristic comprise instructions that cause the one or more programmable control devices to change the value of the first characteristic dynamically based on at least one of ambient conditions, perceptual adaption conditions, and a user operation.

16. An electronic device comprising:

a display device;

memory; and one or more processors operatively coupled to the memory and the display device, wherein the memory comprises instructions that, when executed by the one or more processors, cause the one or more processors to:

set pixel adjustment values for each of a plurality of gray levels to first pixel adjustment values in response to the display device being set to a first state in which a value of a first characteristic of the display device is set to a first value, wherein the first pixel adjustment values are based on actual values for each of the plurality of gray levels measured during a calibration process when the first characteristic of the output device is set to the first value;

change the value of the first characteristic of the display device from the first value to a second value to set the display device to a second state;

update the pixel adjustment values for each of the plurality of gray levels to second pixel adjustment values in response to the display device being set to the second state via a dynamic gray tracking operation, wherein the second pixel adjustment values are dynamically derived based on the second value of the first characteristic of the display device and based on the first pixel adjustment values; and correct pixel values applied to a plurality of pixels of the display device based on the second pixel adjustment values.

17. The electronic device of claim 16, wherein the first characteristic comprises at least one of a white point, a black point, gamma, and a thermal component, of the display device.

18. The electronic device of claim 17, wherein the instructions that, when executed by the one or more processors, cause the one or more processors to update the pixel adjustment values for each of the plurality of gray levels comprise instructions that, when executed by the one or more processors, cause the one or more processors to:

access a plurality of measured correction tables of pixel adjustment values for each of the plurality of gray levels, the plurality of correction tables respectively corresponding to different values of the first characteristic of the display device, wherein the first pixel adjustment values are included in one of the plurality of measured correction tables that corresponds to the first value of the first characteristic of the display device; and interpolate pixel adjustment values of two or more correction tables from among the plurality of correction tables to generate the second pixel adjustment values in response to the display device being set to the second state.

19. The electronic device of claim 18, wherein the instructions that, when executed by the one or more processors, cause the one or more processors to access the plurality of correction tables of pixel adjustment values comprise instructions that, when executed by the one or more processors, cause the one or more processors to:

measure, for each of the respective values of the first characteristic of the display device, actual pixel response of the display device for gray levels to generate the plurality of correction tables of pixel adjustment values, wherein the respective values correspond to a plurality of white points of the display device set in a one-dimensional space, and wherein the interpolation comprises bi-linear interpolation of a weighted average of correction tables of two of the plurality of white points which are closest to a target white point to which the display device is set in the second state.

20. A method comprising:

setting an output device to a first state in which a value of a first characteristic of the output device is set to a first value;

setting pixel adjustment values for each of a plurality of gray levels to first pixel adjustment values in response to the output device being set to the first state, wherein the first pixel adjustment values are based on actual values for each of the plurality of gray levels measured during a calibration process when the first characteristic of the output device is set to the first value;

changing the value of the first characteristic of the output device from the first value to a second value to set the output device to a second state;

updating the pixel adjustment values for each of the plurality of gray levels to second pixel adjustment values in response to the output device being set to the second state via a dynamic gray tracking operation, wherein the second pixel adjustment values are dynamically derived based on the second value of the first characteristic of the output device and based on the first pixel adjustment values; and correcting pixel values applied to a plurality of pixels of the output device based on the second pixel adjustment values.

* * * * *